US010991531B2

(12) United States Patent
Nishiguchi et al.

(10) Patent No.: US 10,991,531 B2
(45) Date of Patent: Apr. 27, 2021

(54) ELECTROMAGNETIC RELAY

(71) Applicants: DENSO CORPORATION, Kariya (JP); SOKEN, INC., Nisshin (JP); DENSO ELECTRONICS CORPORATION, Anjo (JP)

(72) Inventors: Yoshitaka Nishiguchi, Nisshin (JP); Shota Iguchi, Kariya (JP); Takahiro Soki, Kariya (JP); Hiroaki Murakami, Anjo (JP); Masanao Sugisawa, Anjo (JP)

(73) Assignees: DENSO CORPORATION, Kariya (JP); SOKEN, INC., Nisshin (JP); DENSO ELECTRONICS CORPORATION, Anjo (JP)

( * ) Notice: Subject to any disclaimer, the term of this patent is extended or adjusted under 35 U.S.C. 154(b) by 238 days.

(21) Appl. No.: 16/359,547

(22) Filed: Mar. 20, 2019

(65) Prior Publication Data

US 2019/0221392 A1 Jul. 18, 2019

Related U.S. Application Data

(63) Continuation of application No. PCT/JP2017/039645, filed on Nov. 2, 2017.

(30) Foreign Application Priority Data

| | | |
|---|---|---|
| Nov. 4, 2016 | (JP) | JP2016-216542 |
| Feb. 28, 2017 | (JP) | JP2017-036129 |
| Feb. 28, 2017 | (JP) | JP2017-037371 |

(51) Int. Cl.
*H01H 50/18* (2006.01)
*H01H 50/36* (2006.01)
(Continued)

(52) U.S. Cl.
CPC ..... *H01H 50/18* (2013.01); *H01H 50/14* (2013.01); *H01H 50/36* (2013.01); *H01H 50/443* (2013.01); *H01H 2205/002* (2013.01)

(58) Field of Classification Search
CPC ..... H01H 50/18; H01H 50/36; H01H 50/14; H01H 50/443; H01H 2205/002; H01H 50/163
See application file for complete search history.

(56) References Cited

U.S. PATENT DOCUMENTS

| | | | | |
|---|---|---|---|---|
| 10,535,483 | B2 * | 1/2020 | Nishiguchi | H01H 50/16 |
| 2012/0105178 | A1 | 5/2012 | Niimi | |

(Continued)

*Primary Examiner* — Mohamad A Musleh
(74) *Attorney, Agent, or Firm* — Oliff PLC

(57) ABSTRACT

A stationary core is in an exciting coil. A yoke covers an outer periphery and an axial end of the exciting coil to form a magnetic circuit and has an opening portion. The movable core faces the stationary core through the opening portion and is attracted toward the stationary core on energization of the exciting coil. A return spring urges the movable core against the attraction direction. A first gap is formed between the stationary core and the movable core on deenergization of the exciting coil. A second gap is formed between the yoke and the movable core on deenergization of the exciting coil. The second gap allows the yoke and the movable core to generate an attractive force therebetween on energization of the exciting coil. The return spring is made of a magnetic material to magnetically bridge the first gap or the second gap.

16 Claims, 21 Drawing Sheets

(51) Int. Cl.
*H01H 50/14* (2006.01)
*H01H 50/44* (2006.01)

(56) References Cited

U.S. PATENT DOCUMENTS

| | | | | |
|---|---|---|---|---|
| 2013/0335177 | A1* | 12/2013 | Enomoto | H01H 1/20<br>335/192 |
| 2016/0225565 | A1 | 8/2016 | Sugisawa et al. | |
| 2018/0061544 | A1* | 3/2018 | Tanaka | H01F 7/1653 |

* cited by examiner

LARGE AIR GAP

· × ← MAGNETIC FLUX FLOW

SMALL AIR GAP

· × ← MAGNETIC FLUX FLOW

ELECTROMAGNETIC RELAY

CROSS REFERENCE TO RELATED APPLICATION

The present application is a continuation application of International Patent Application No. PCT/JP2017/039645 filed on Nov. 2, 2017, which designated the U.S. and claims the benefit of priority from Japanese Patent Applications No. 2016-216542 filed on Nov. 4, 2016, No. 2017-36129 filed on Feb. 28, 2017, and No. 2017-37371 filed on Feb. 28, 2017. The entire disclosures of all of the above applications are incorporated herein by reference.

TECHNICAL FIELD

The present disclosure relates to an electromagnetic relay.

BACKGROUND

Conventionally, an electromagnetic relay is widely used to cause connection and disconnection in an electric circuit by manipulating its moving core.

SUMMARY

According to an aspect of the present disclosure, an electromagnetic relay includes a coil, a stationary core, a movable core, a yoke, and a spring. The movable core faces the stationary core through the yoke. The spring urges the movable core against attraction force caused by energization of the coil.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
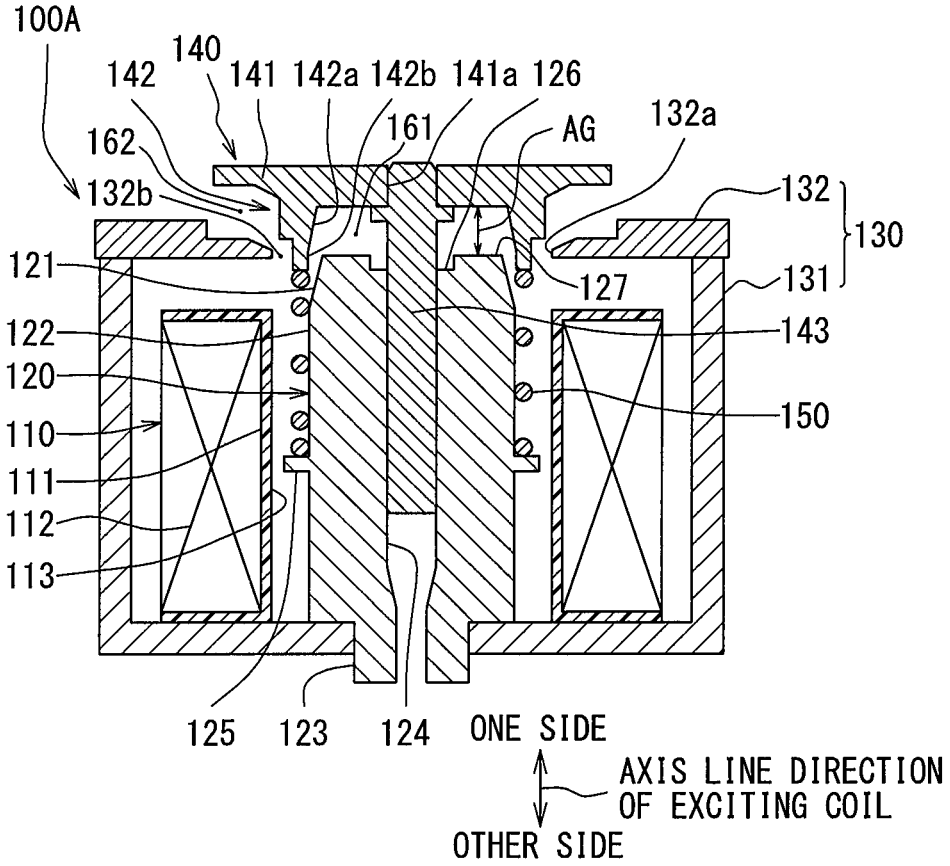
FIG. 1 is a cross-sectional view showing an electromagnetic relay according to a first embodiment.

To begin with, an example of the present disclosure will be described as follows. According to an example, an electromagnetic relay includes an exciting coil for forming a magnetic field when energized, a stationary core fixed to a center portion of the exciting coil, a yoke covering an outer periphery and an end in an axial direction of the exciting coil, a movable core attracted toward the stationary core when energized, and a contact portion (contact) for intermittently connecting and disconnecting a power supply line to a predetermined device in accordance with a movement of the movable core.

In more detail, according to the example, a stationary core tapered portion and a stationary core circular portion are formed at a tip portion of the stationary core. The stationary core tapered portion expands in diameter toward a rear end portion. The stationary core circular portion extends from the stationary core tapered portion toward the rear end side with a constant outer diameter. The movable core is provided with a movable core hole into which the tip portion of the stationary core can penetrate at the time of attraction. An inner peripheral surface of the movable core hole is formed with a movable core cylindrical portion and a movable core tapered cylinder portion. The movable core cylindrical portion extends at a constant inner diameter toward an opposite side of the stationary core. The movable core tapered cylinder portion has an inner peripheral surface which decreases in diameter toward the opposite side of the stationary core.

In the example, when the energization of the exciting coil is interrupted, the tip portion of the movable core cylindrical portion is positioned (overlapped) in a region of the stationary core tapered portion. As a result, an air gap (gap) in a radial direction between the stationary core and the movable core at the start of energization can be reduced, and an opposing area between the stationary core and the movable core is increased, so that an electromagnetic attractive force of the movable core at the start of energization is increased.

Herein, it would be difficult to set the air gap in the radial direction between the stationary core and the movable core to be further smaller in a manner that a necessary gap for the movable core to operate is secured.

Further, for example, in order to prevent a contact portion from becoming in an energized state due to an arc discharge at the time of emergency interruption, the gap in the axial direction between the stationary core and the movable core is required to secure a predetermined gap (safety gap) which is determined in advance when the movable core is separated from the stationary core (when de-energized).

Therefore, because of setting the gap between the stationary core and the movable core to be small in advance, a restriction would arise in the electromagnetic attractive force at the start of energization.

Another example will be described as follows. An electromagnetic relay for controlling on/off of an electric circuit forms a magnetic circuit passing through the stationary core and the yoke based on the energization of the exciting coil, and magnetically attracts the movable core together with a shaft, thereby bringing a movable contact attached to the shaft and a fixed contact provided in a non-movable portion into contact with each other to turn on the electric circuit. Further, the exciting coil is deenergized to turn off the magnetic circuit, and the shaft and the movable core turn to a rest position side to separate the movable contact and the fixed contact from each other to turn off the electric circuit. In this example, a return spring is provided between the stationary core and the movable core so that the shaft and the movable core can be properly returned to the rest position side.

In this example, it is assumed that the return spring of the electromagnetic relay is made of a magnetic material. In this example, it is further assumed that adsorption surfaces of the stationary core and the movable core are placed inside a fitting portion of the return spring including the movable core and the coil spring. In this way, the configuration could restrict an interference between the stationary core and the return spring and stabilizing an operating voltage. In this example, the spring is made of a magnetic material to be a part of the magnetic circuit, and a force attracting each other between the windings is obtained, thereby lowering the operating voltage.

In this example in which the return spring is made of a magnetic material, a return spring has both a function of forming a magnetic circuit and a function as a separation spring for urging the shaft and the movable core so as to separate the movable contact from the fixed contact (hereinafter, referred to as a non-attraction direction). For that reason, the return spring could be required to have a complicated configuration to perform both the functions.

In consideration of the above issues, according to an example of the present disclosure, an electromagnetic relay comprises an exciting coil configured to form a magnetic field on energization. The electromagnetic relay further comprises a stationary core placed in a coil center hole formed in an inner diameter portion of the exciting coil and configured to form a magnetic circuit. The electromagnetic relay further comprises a yoke placed to cover an outer periphery of the exciting coil and an end of the exciting coil in an axial direction to form a magnetic circuit. The yoke has an opening portion formed in its one side in the axial direction correspondingly to a position of the stationary core. The electromagnetic relay further comprises a movable core facing the stationary core through the opening portion and to be attracted toward the stationary core on energization of the exciting coil. The electromagnetic relay further comprises a return spring configured to urge the movable core in a direction opposite to a direction of attraction. A first gap is formed between the stationary core and the movable core on deenergization of the exciting coil. A second gap is formed between the yoke and the movable core on deenergization of the exciting coil. The second gap allows the yoke and the movable core to generate an attractive force therebetween in a direction to attract the movable core toward the stationary core on energization of the exciting coil. The return spring is made of a magnetic material and is placed to magnetically bridge the first gap or the second gap.

The electromagnetic relay may enable to generate more attractive force at the start of energization.

According to another example of the present disclosure, an electromagnetic relay comprises an exciting coil configured to form a magnetic field on energization. The electromagnetic relay further comprises a stationary core placed in a center hole formed in an inner diameter portion of the exciting coil and configured to form a part of a magnetic circuit on energization of the exciting coil. The electromagnetic relay further comprises a yoke placed to cover an outer periphery of the exciting coil and an end of the exciting coil in the axial direction and configured to form a part of the magnetic circuit. The yoke has an opening portion correspondingly to a position of the stationary core in its one side in the axial direction. The electromagnetic relay further comprises a movable core facing the stationary core at a position corresponding to the opening portion and configured to be attracted toward the stationary core by a magnetic attraction force on energization of the exciting coil. The electromagnetic relay further comprises a movable contact having a movable contact element and movable to follow the movable core. The electromagnetic relay further comprises a plurality of fixed terminals having fixed contacts configured to make contact with the movable coil on energization of the exciting coil. The electromagnetic relay further comprises a return spring configured to urge the movable core in a direction away from the stationary core. The return spring is formed of a plurality of springs. At least one of the plurality of springs is made of a magnetic material.

The electromagnetic relay may enable the return spring to have a less complicated configuration.

Hereinafter, multiple modes for carrying out the present disclosure will be described with reference to the drawings. In each of the embodiments, the same reference numerals are assigned to portions corresponding to the items described in the preceding embodiments, and a repetitive description of the corresponding portions may be omitted. In each embodiment, when only a part of the configuration is described, another embodiment previously described can be employed for other parts of the configuration. Not only portions which are specifically clarified so as to be combined in each embodiment are capable of being combined, but also embodiments are capable of being partially combined with each other even though combination is not clarified as long as no adverse effect is particularly generated with respect to the combination.

First Embodiment

An electromagnetic relay 100A according to a first embodiment will be described with reference to FIGS. 1 and 2. The electromagnetic relay 100A is a so-called device (so-called relay) for intermittently supplying an electric power to a predetermined device. The electromagnetic relay 100A is applied as a predetermined device to, for example, an inverter that converts (for example, DC-AC conversion) an electric power from a battery to be supplied to a drive motor for traveling mounted on a hybrid vehicle or an electric vehicle. The electromagnetic relay 100A is placed between the battery and the inverter.

The electromagnetic relay 100A includes an exciting coil 110, a stationary core 120, a yoke 130, a movable core 140, a return spring 150, and the like, which configure a main part, in a case not shown. The case is made of, for example, resin, and a base made of resin for holding the main part of the inside is provided in the case. The base is fixed to the case by bonding or fitting with a claw or the like.

Hereinafter, a direction of respective members or placements between the respective members will be described with reference to an axis line direction of the exciting coil 110 (vertical direction in FIG. 1). The axis line direction coincides with, for example, a direction in which the stationary core 120 and the movable core 140, which will be described later, are aligned, and the movable core 140 side in the axis line direction is referred to as one side, and the stationary core 120 side in the axis line direction is referred to as the other side. The axis line direction corresponds to the axial direction of the present disclosure.

The exciting coil 110 has a cylindrical shape and forms a magnetic field when energized, and is fixedly placed at a bottom of the yoke 130 (to be described later) (a bottom of a first yoke 131). The exciting coil 110 includes a bobbin 111, a coil portion 112, and the like. The bobbin 111 is a member made of resin, and has a cylindrical portion and flat plate-like flange portions integrally formed at both ends of the cylindrical portion in the axis line direction. The coil portion 112 is formed by winding a conductive wire around the cylindrical portion of the bobbin 111. The conductive wire is wound along a circumferential direction of the cylindrical portion of the bobbin 111. A space of an inner diameter portion of the exciting coil 110 (the cylindrical portion of the bobbin 111) is a coil center hole 113. In the present embodiment, the axis line direction of the exciting coil 110 is the vertical direction in FIG. 1.

The stationary core 120 is a columnar member placed in the coil center hole 113 of the exciting coil 110, and forming a magnetic circuit together with the yoke 130, which will be described later. The stationary core 120 is made of a magnetic metal material. The direction of the center axis of the stationary core 120 coincides with the axis line direction of the exciting coil 110. The stationary core 120 has a tapered portion 121, a circular portion 122, a small diameter portion 123, a center hole 124, a stopper portion 125, and the like.

The tapered portion 121 is a portion that expands in diameter from one end of the stationary core 120 in the axis line direction (that is, the end of the movable core 140 side), toward the other side in the axis line direction. The circular portion 122 is a portion that extends from the other end of the tapered portion 121 in the axis line direction toward the other side, and whose outer diameter is set to be constant. The small diameter portion 123 is a portion that extends further toward the other side of the circular portion 122 from the other end of the circular portion 122 in the axis line direction, and whose outer diameter dimension is set to be smaller than that of the circular portion 122.

The center hole 124 is a hole formed so as to penetrate along the center axis of the stationary core 120. An inner diameter dimension of the center hole 124 is gradually changed halfway so as to correspond to the outer diameter dimensions of the circular portion 122 and the small diameter portion 123. The stopper portion 125 is a portion that is provided on an outer peripheral surface serving as an intermediate portion of the stationary core 120 in the axis line direction, and protrudes outward in the radial direction. The stopper portion 125 supports the other end of the return spring 150 in the axis line direction, which will be described later.

A recess portion 126, which is a cylindrical recess space, is provided in a center portion of one end of the stationary core 120 in the axis line direction (that is, an end face of the tapered portion 121) and a protrusion portion 127, which is a continuous protrusion in an annular shape, is provided around the recess portion 126.

The stationary core 120 is fixed to the yoke 130 by inserting and joining the small diameter portion 123 into a hole formed in a bottom of the yoke 130 (a bottom of the first yoke 131), which will be described later.

The yoke 130 is a member that forms a magnetic circuit together with the stationary core 120, and accommodates the exciting coil 110, the stationary core 120, and a return spring 150, which will be described later, inside, and has a first yoke 131, a second yoke 132, and the like.

The first yoke 131 is, for example, a member formed by bending a strip material of a magnetic metal into a U-shape, and covers a region facing the exciting coil 110 on an outer peripheral side of the exciting coil 110 and the other side of the exciting coil 110 in the axis line direction.

The second yoke 132 is a plate-like member made of a magnetic metal material, and is placed on an opening side of the first yoke 131 (one end in the axis line direction). Both ends of the second yoke 132 are joined to the opening side end portion of the first yoke 131.

A yoke hole 132*a* is provided and opened in a region of the second yoke 132 corresponding to a position of the stationary core 120. The yoke hole 132*a* has, for example, a circular shape. The yoke hole 132*a* corresponds to an opening portion of the present disclosure. Therefore, the second yoke 132 covers one side of the exciting coil 110 in the axis line direction in the region of the exciting coil 110 excluding the coil center hole 113. A gap 132*b* having a predetermined dimension is provided between a periphery of the yoke hole 132*a* of the second yoke 132 and a periphery of one end of the stationary core 120 in the axis line direction.

The movable core 140 is placed to face the stationary core 120 through the yoke hole 132*a*, and is attracted to the stationary core 120 side when the exciting coil 110 is energized. The movable core 140 includes a plate portion 141, a protrusion portion 142, a shaft portion 143, and the like.

The plate portion 141 is, for example, a circular plate member whose plate surface extends in a direction perpendicular to the center axis of the stationary core 120. A circular hole 141*a* is provided in the center of the plate portion 141. An outer diameter dimension of the plate portion 141 is set to be larger than an inner diameter dimension of the yoke hole 132*a*.

The protrusion portion 142 is a cylindrical member projecting toward the stationary core 120 from a center region of the other surface of the plate portion 141 in the axis line direction. An outer diameter dimension of the protrusion portion 142 is set to be smaller than an inner diameter dimension of the yoke hole 132*a*, and an inner diameter dimension of the protrusion portion 142 is set to be larger than an outer diameter dimension of the circular portion 122 of the stationary core 120. A tip portion (protrusion side end portion) of the other end of the axis of the protrusion portion 142 in the axis line direction is set to a position to enter the gap 132*b* in a state where the movable core 140 is the farthest away from the stationary core 120 (at the time of deenergization), and enters the gap 132*b*.

A tapered portion 142*a* and a cylindrical portion 142*b* are formed on an inner peripheral surface of the protrusion portion 142. The tapered portion 142*a* is provided in a region of an inner peripheral surface of the protrusion portion 142 on one side in the axis line direction such that the inner diameter dimension is enlarged from one side toward the other side. The cylindrical portion 142*b* is formed so that the inner diameter dimension is kept constant from the other end the tapered portion 142*a* further toward the other side.

The shaft portion 143 is, for example, a rod-shaped member having a circular cross section, and one end in the axis line direction is inserted into the hole 141*a* and bonded to the plate portion 141. The other end of the shaft portion 143 in the axis line direction is slidably inserted into the center hole 124 of the stationary core 120.

Therefore, the movable core 140 can move in the axis line direction with respect to the stationary core 120 by the shaft portion 143 sliding in the center hole 124. When the movable core 140 moves to the stationary core 120 side (at the time of energization), the tapered portion 121 of the stationary core 120 and a part of the circular portion 122 on one side in the axis line direction can relatively enter an internal space of the protrusion portion 142 of the movable core 140.

An air gap AG is provided between the plate portion 141 in the center region of the movable core 140 (an inner region of the protrusion portion 142) and the protrusion portion 127 of the stationary core 120.

When the exciting coil 110 is not energized, a gap (corresponding to a maximum air gap AG to be described later) provided between the stationary core 120 (the protrusion portion 127) and the movable core 140 (the plate portion 141) defines a first gap 161. When the exciting coil 110 is deenergized, a gap provided between the yoke 130 (the second yoke 132) and the movable core 140 (the plate portion 141 and the protrusion portion 142) defines a second gap 162. The second gap 162 is a gap between the yoke 130 (the second yoke 132) and the movable core 140 (the plate portion 141 and the protrusion portion 142), which can generate an attractive force in the axis line direction of the exciting coil 110 (a direction to attract the movable core 140 to the stationary core 120 side) when the exciting coil 110 is energized.

The return spring 150 is a member that is placed on the outer peripheral side of the stationary core 120 and urges the movable core 140 to one side in the axis line direction (in a direction opposite to the attraction direction). The return spring 150 is formed of, for example, a metal coil spring and is inserted into the outer peripheral portion of the stationary core 120. The other end of the return spring 150 in the axis line direction is in contact with the stopper 125 of the stationary core 120. One end of the return spring 150 in the axis line direction is brought in contact with a protrusion side end portion of the protrusion portion 142 of the movable core 140 (the other side end in the axis line direction).

Regardless of a position of the movable core 140, one end of the return spring 150 in the axis line direction is always in contact with the movable core 140. When the return spring 150 urges the movable core 140 in one side of the axis line direction (at the time of deenergization), one side of the return spring 150 in the axis line direction is placed adjacent to the gap 132*b*.

In the present embodiment, the return spring 150 is made of a magnetic material. The return spring 150 can be made of a magnetic material by, for example, performing a heat treatment or the like on a non-magnetic material.

Since the return spring 150 is made of the magnetic material as described above, the return spring 150 is placed to magnetically bridge between the stationary core 120 and the movable core 140, that is, both the cores 120 and 140 in the first gap 161.

Incidentally, in a case (not shown), a contact portion (not shown) is provided on one side of the movable core 140 in the axis line direction, which performs intermittence of a power supply line with respect to a predetermined device in conjunction with the movement of the movable core 140. When the movable core 140 is not attracted to the stationary core 120 (at the time of deenergization), the movable core 140 is moved to one side in the axis line direction by an urging force of the return spring 150, and the contact portion is cut off. At this time, for example, the movable core 140 is stopped at the farthest distance from the stationary core 120 by a position regulation portion at the contact portion. The air gap AG at this time becomes the maximum air gap, and is set to, for example, about 2.5 mm to 3 mm.

Conversely, when the movable core 140 is attracted to the stationary core 120 (at the time of energization), the movable core 140 is moved to the other side in the axis line direction by the attractive force, and the contact portion is connected. At that time, the movable core 140 (the plate portion 141) comes into contact with the stationary core 120 (the protrusion portion 127) and stops. The air gap AG at that time is set to a minimum air gap (zero).

The electromagnetic relay 100A is configured as described above, and the operation and operation and effects of the electromagnetic relay 100A will be described below with reference to FIG. 2.

First, when the energization of the exciting coil 110 is interrupted (at the time of deenergization), a magnetic field is not developed by the exciting coil 110 and no attractive force exerted on the movable core 140 is generated, and as shown in FIG. 1, the movable core 140 is driven to one side in the axis line direction by the return spring 150. As a result, the contact portion (not shown) is in a disconnected state, and a power supply to a predetermined device is not performed.

In a state in which the energization of the exciting coil 110 is interrupted, a part of the tapered portion 121 of the stationary core 120 is located in the protrusion portion 142 of the movable core 140, and the other end of the cylindrical portion 142*b* of the movable core 140 in the axis line direction and the tapered portion 121 of the stationary core 120 overlap with each other in a direction orthogonal to the axis line direction.

In addition, one end of the return spring 150 in the axis line direction is located adjacent to the gap 132*b* because the return spring 150 is in contact with the protrusion side end portion of the protrusion portion 142 of the movable core 140. The air gap AG has a maximum value.

On the other hand, when the exciting coil 110 is energized (at the time of energization), a magnetic field is developed between the stationary core 120 and the movable core 140 and between the movable core 140 and the yoke 130 by the exciting coil 110.

In this example, since the return spring 150 is made of a magnetic material and is placed so as to magnetically bridge the first gap 161 (between the stationary core 120 and the movable core 140), the generation of the attractive force at the time of energization in the first gap 161 is reduced.

However, the magnetoresistance in the first gap 161 can be reduced by the return spring 150 made of a magnetic material, and a total magnetic flux passing through the stationary core 120, the movable core 140, and the yoke 130 can be increased when the exciting coil 110 is energized.

As the total magnetic flux increases, the attractive force generated in the second gap 162 (attractive force in the direction to attract the movable core 140 to the stationary core 120 side) can be increased. In general, this increased attractive force can improve the attractive force acting on the movable core 140 toward the stationary core 120.

The movable core 140 is attracted to the stationary core 120 side against the return spring 150 by the attractive force. As a result, the contact portion (not shown) is in a connected state, and a power supply to a predetermined device is performed.

When the exciting coil 110 is energized, the movable core 140 moves to a position where the center region of the plate portion 141 of the movable core 140 comes in contact with the protrusion portion 127 of the stationary core 120. In other words, the air gap AG becomes zero from the maximum value. In a state in which the center region of the plate portion 141 is in contact with the protrusion portion 127, the tapered portion 121 of the stationary core 120 and a part of one side the circular portion 122 in the axis line direction is located in the protrusion portion 142 of the movable core 140 that has moved.

The position of one end of the return spring 150 in the axis line direction moves to the other side in the axis line direction by the moving amount of the movable core 140 (as much as the maximum air gap AG), and moves away from the gap 132*b* to the other side in the axis line direction.

Since one end of the return spring 150 in the axis line direction is placed adjacent to the gap 132*b* in a deenergized state, a magnetoresistance between the stationary core 120 and the yoke 130 (second yoke 132) in an energized state can be reduced. Therefore, the magnetic flux at the start of energization in the exciting coil 110 can be increased to improve the attractive force of the movable core 140 to the stationary core 120 side.

Figure 2:
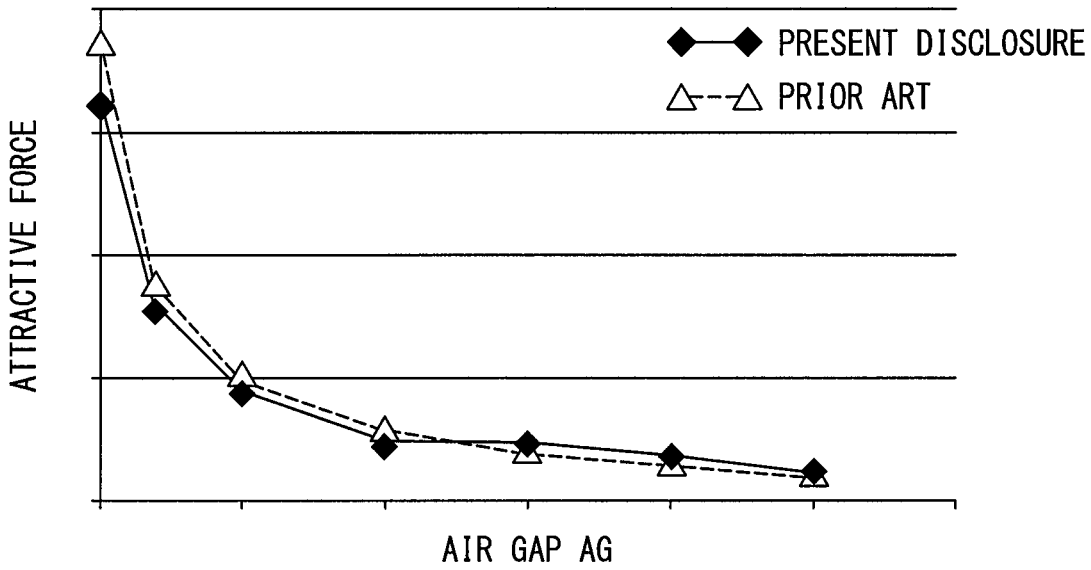
FIG. 2 is a graph showing an attractive force with respect to an air gap according to the first embodiment.

FIG. 2 shows a relationship between the air gap AG based on a theoretical analysis and the attractive force acting on the movable core 140 according to the present embodiment. According to the present embodiment, the attractive force is improved in a region where the air gap AG reaches from a maximum value to an intermediate value as compared with the prior art.

Second Embodiment

Figure 3:
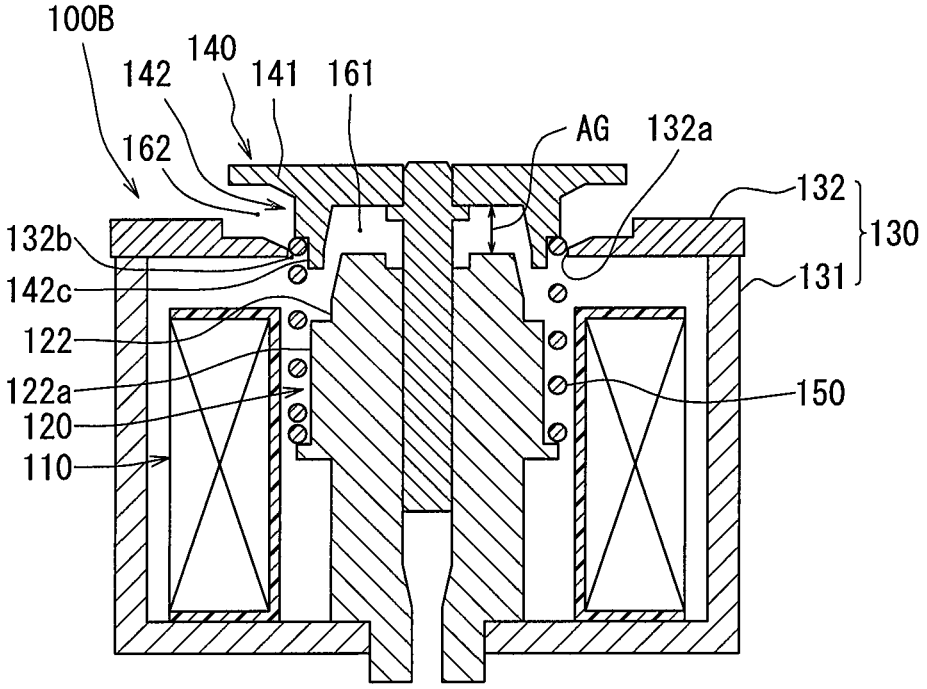
FIG. 3 is a cross-sectional view showing an electromagnetic relay according to a second embodiment.
Figure 4:
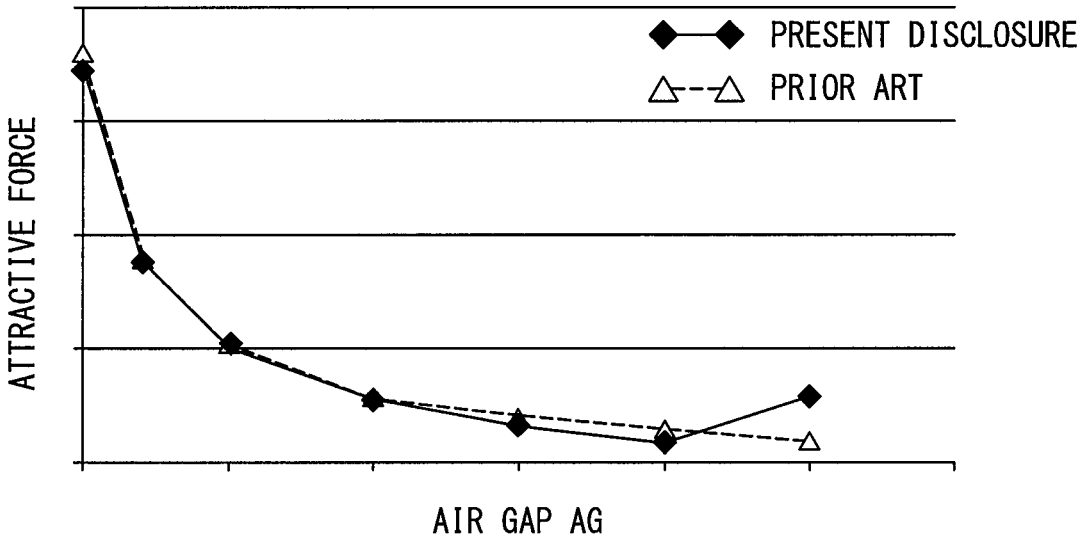
FIG. 4 is a graph showing an attractive force with respect to an air gap according to the second embodiment.

An electromagnetic relay 100B according to a second embodiment is shown in FIGS. 3 and 4. In the second embodiment, a position of one end of a return spring 150 in an axis line direction is changed as compared with the first embodiment.

In a stationary core 120, a large diameter portion 122*a* having an outer diameter dimension set to be further larger is formed in a circular portion 122 between a position out of a region which can enter an inside of a protrusion portion 142 of a movable core 140 and a stopper portion 125.

In the movable core 140, a step 142*c* is provided on an outer peripheral surface of the protrusion portion 142. The step 142*c* is formed by reducing an outer diameter dimension of the other side (a tip portion side) of the protrusion portion 142 in the axis line direction by one size.

The return spring 150 is set to an inner diameter dimension that can be inserted into the large diameter portion 122*a* of the stationary core 120, and one end of the return spring 150 in the axis line direction is in contact with a boundary portion whose outer diameter dimension changes by the step portion 142*c*. Therefore, when the return spring 150 urges the movable core 140 toward one side in the axis line direction (at the time of deenergization), one side of the return spring 150 in the axis line direction is placed to enter the region of the gap 132*b*.

At the time of energization, a position of one end of the return spring 150 in the axis line direction moves to the other side in the axis line direction by an amount of movement of the movable core 140 (corresponding to the maximum air gap AG) due to the attractive force, and moves away from the gap 132 *b* to the other side in the axis line direction.

In the present embodiment, a theory of improving the attractive force of the movable core 140 toward the stationary core 120 side is the same as that in the first embodiment.

In the present embodiment, the return spring 150 is positioned between the stationary core 120 and the yoke 130 and between the movable core 140 and the yoke 130 at the start of energization. Therefore, a part (one side in the axis line direction) of the return spring 150 can increase a magnetic flux in the gap 132*b* at the start of energization (at the maximum of the air gap AG), that is, between the stationary core 120 and the periphery of the yoke hole 132*a*, and further a magnetic flux between the movable core 140 (the protrusion portion 142) and the periphery of the yoke hole 132*a*, thereby being capable of effectively improving the attractive force acting on the movable core 140 at the start of energization.

FIG. 4 shows a relationship between the air gap AG based on the theoretical analysis and the attractive force acting on the movable core 140 in the present embodiment. In the present embodiment, when the air gap AG is at the maximum (at the start of energization), the attractive force is improved as compared with the prior art.

Third Embodiment

Figure 5A:
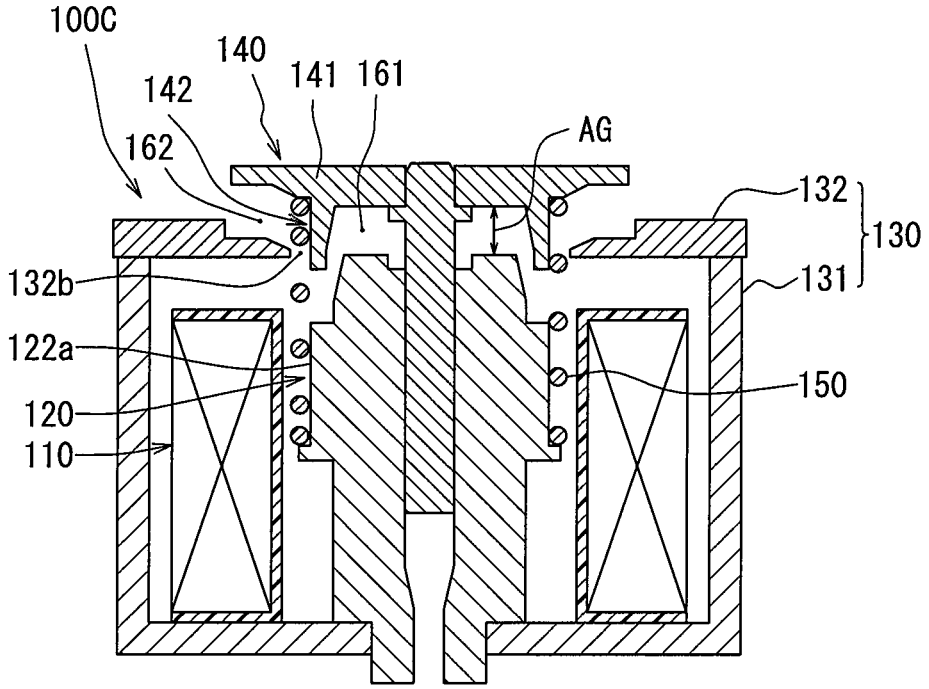
FIGS. 5A and 5B illustrate cross-sectional views showing an electromagnetic relay according to a third embodiment.
Figure 5B:
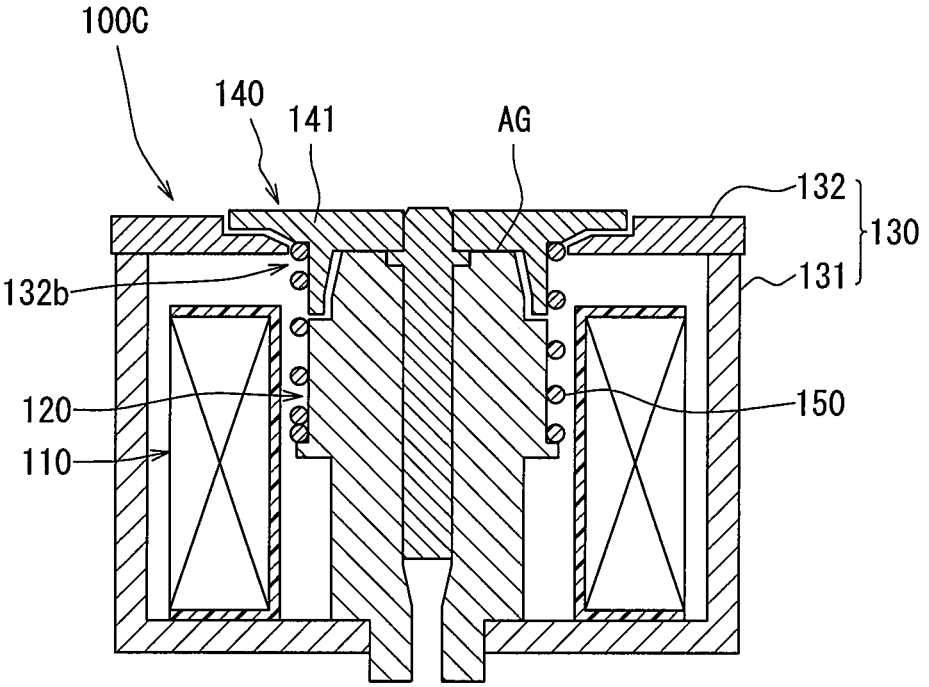
Figure 6:
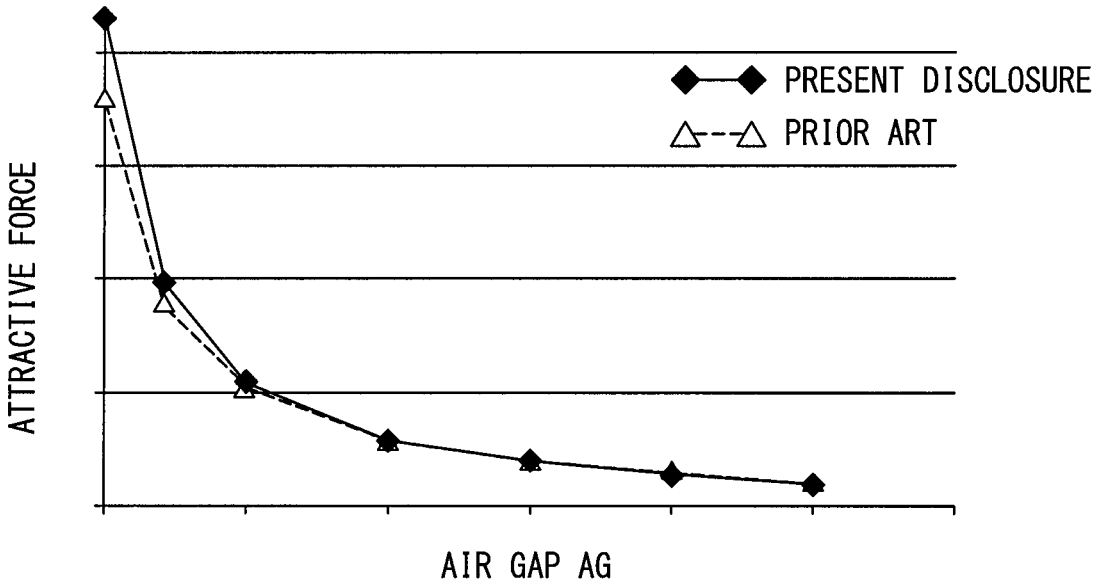
FIG. 6 is a graph showing an attractive force with respect to an air gap according to the third embodiment.
Figure 7A:
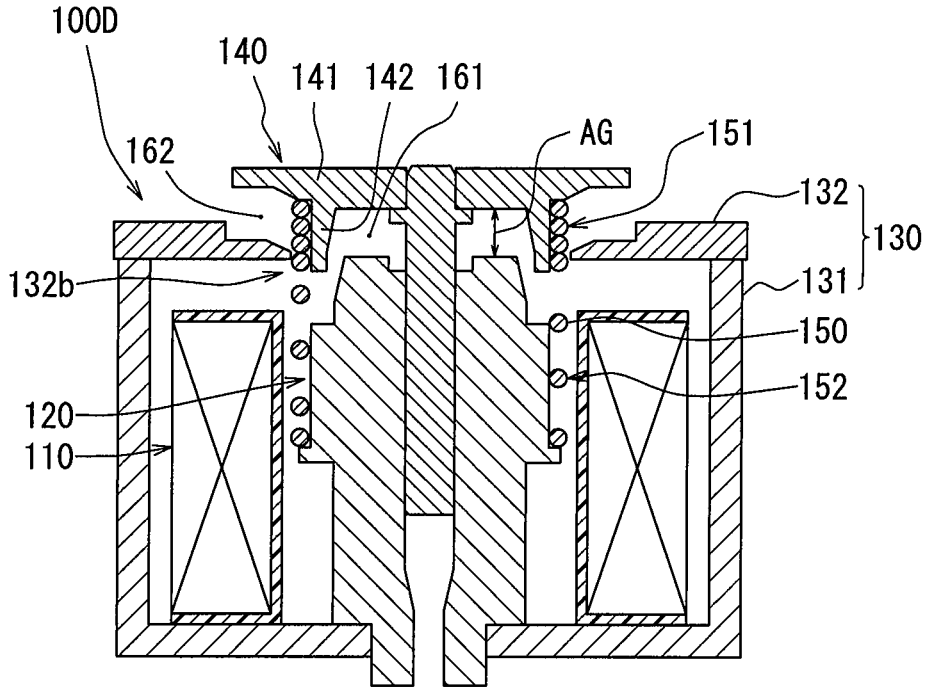
FIGS. 7A and 7B illustrate cross-sectional views showing an electromagnetic relay according to a fourth embodiment.
Figure 7B:
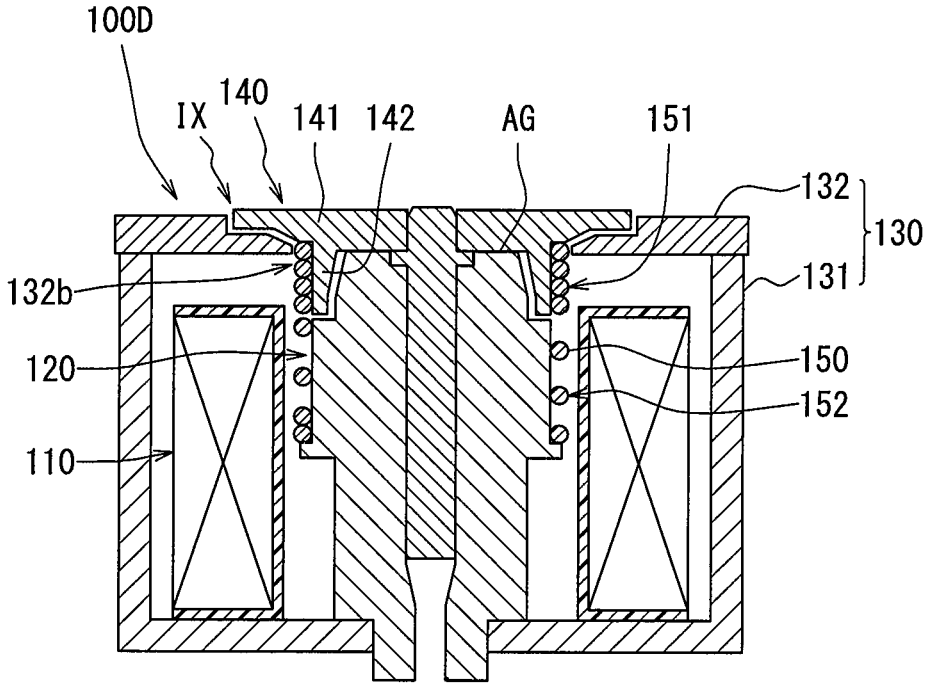

An electromagnetic relay 100C according to a third embodiment is shown in FIGS. 5A, 5B, and 6. In the third embodiment, a position of one end of a return spring 150 in an axis line direction is further changed as compared with the second embodiment.

In a movable core 140, the step 142*c* described in the second embodiment is eliminated, and an outer diameter dimension of a protrusion portion 142 of the movable core 140 coincides with the outer diameter dimension smaller by one size when the step 142*c* is provided in the axis line direction.

A return spring 150 is set to an inner diameter dimension that can be inserted into a large diameter portion 122*a* of a stationary core 120, and one end in the axis line direction passes through the protrusion portion 142 of the movable core 140, and comes in contact with a surface of a plate portion 141 on the stationary core 120 side. Therefore, as shown in FIG. 5A, when the return spring 150 urges the movable core 140 toward one side in the axis line direction (at the time of deenergization), one end of the return spring 150 in the axis line direction is located at a position of the surface of the plate portion 141 on the stationary core 120 side, and one end of the return spring 150 in the axis line direction is placed so as to pass through a gap 132*b*.

Further, as shown in FIG. 5B, at the time of energization, a position of one end of the return spring 150 in the axis line direction moves to the other side in the axis line direction by the amount of movement of the movable core 140 due to the attractive force (corresponding to the maximum air gap AG), but remains in the region of the gap 132*b*.

In other words, according to the present embodiment, a part (one side in the axis line direction) of the return spring 150 is placed so as to pass between the movable core 140 (the stationary core 120) and the yoke 130 (the periphery of the yoke hole 132*a*) during a period from the start of energization to the completion of attraction.

In the present embodiment, a theory of improving the attractive force of the movable core 140 toward the stationary core 120 side is the same as that in the first embodiment.

In the present embodiment, the return spring 150 is located between a movable core 140 (stationary core 120) and the yoke 130 during a period from the start of energizing and the completion of attraction. Therefore, a part (one side in the axis line direction) of the return spring 150 can increase a magnetic flux between the stationary core 120 and the periphery of the yoke hole 132*a* during a period from the start of energization to the completion of attraction, and can further increase the magnetic flux between the movable core 140 (the protrusion portion 142) and the periphery of the yoke hole 132*a*. As a result, the attraction force acting on the movable core 140 from the start of energization to the completion of attraction can be improved.

FIG. 6 shows a relationship between the air gap AG based on the theoretical analysis and the attractive force acting on the movable core 140 according to the present embodiment. According to the present embodiment, the attractive force is improved over the conventional technique in the entire region of the air gap AG, that is, from the start of energization to the completion of attraction, although in a small amount. In particular, according to the present embodiment, the effect of improving the attractive force is high when the air gap AG is on the minimum side (that is, in the vicinity of the completion of attraction).

Fourth Embodiment

An electromagnetic relay 100D according to a fourth embodiment is shown in FIGS. 7A to 9. In the fourth embodiment, a spring pitch of a return spring 150 is changed as compared with the third embodiment.

On one side of the return spring 150 in an axis line direction, a region passing through a gap 132*b* by an attractive force acting on a movable core 140 is set to be smaller in spring pitch than the other region. When the spring pitch is set as described above, a density of the spring itself is relatively high in a region 151 where the spring pitch is small, and the density of the spring itself is relatively low in a region 152 where the spring pitch is large.

In the present embodiment, a theory of improving the attractive force of the movable core 140 toward the stationary core 120 side is the same as that in the first embodiment.

Further, in the present embodiment, in the region 151 having the small spring pitch, a magnetoresistance can be greatly reduced from the start of the energization to the completion of attraction, so that the effect of improving the attractive force acting on the movable core 140 can be enhanced.

Figure 8:
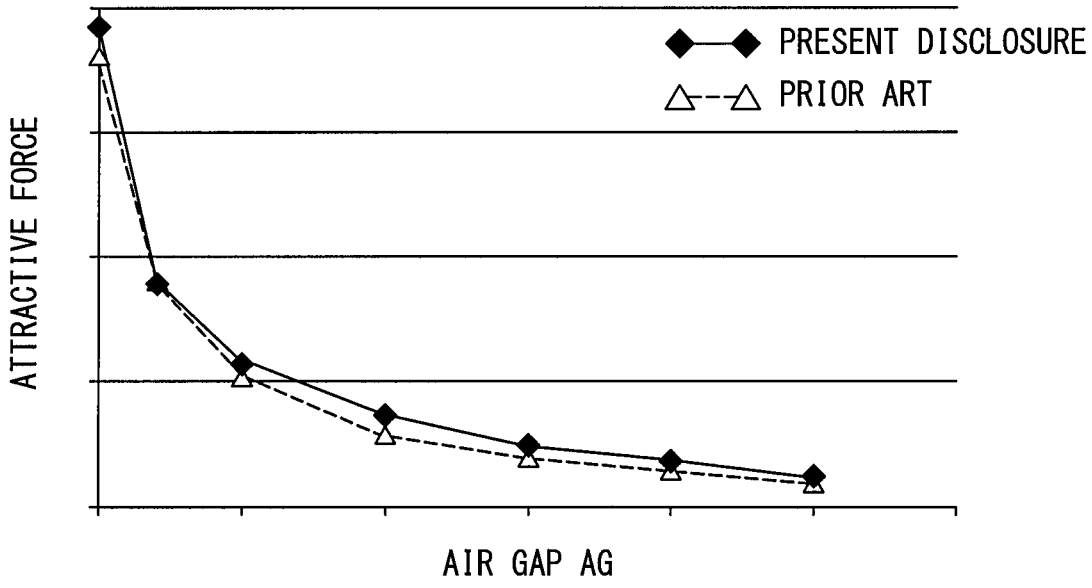
FIG. 8 is a graph showing an attractive force with respect to an air gap according to the fourth embodiment.

FIG. 8 shows a relationship between the air gap AG based on the theoretical analysis and the attractive force acting on the movable core 140 according to the present embodiment. According to the present embodiment, the attractive force is improved over the conventional technique in the entire region of the air gap AG, that is, from the start of energization to the completion of attraction.

In the case where an outer diameter dimension of a protrusion portion 142 of the movable core 140 is set to correspond to an outer diameter dimension of the region 151 having the small spring pitch (to increase a wall thickness) instead of the region 151 having the small spring pitch of the return spring 150, a magnetic flux path is simply provided from the protrusion portion 142 in a horizontal direction toward the second yoke 132, and a downward (axis line direction) attractive force cannot be obtained.

Figure 9:
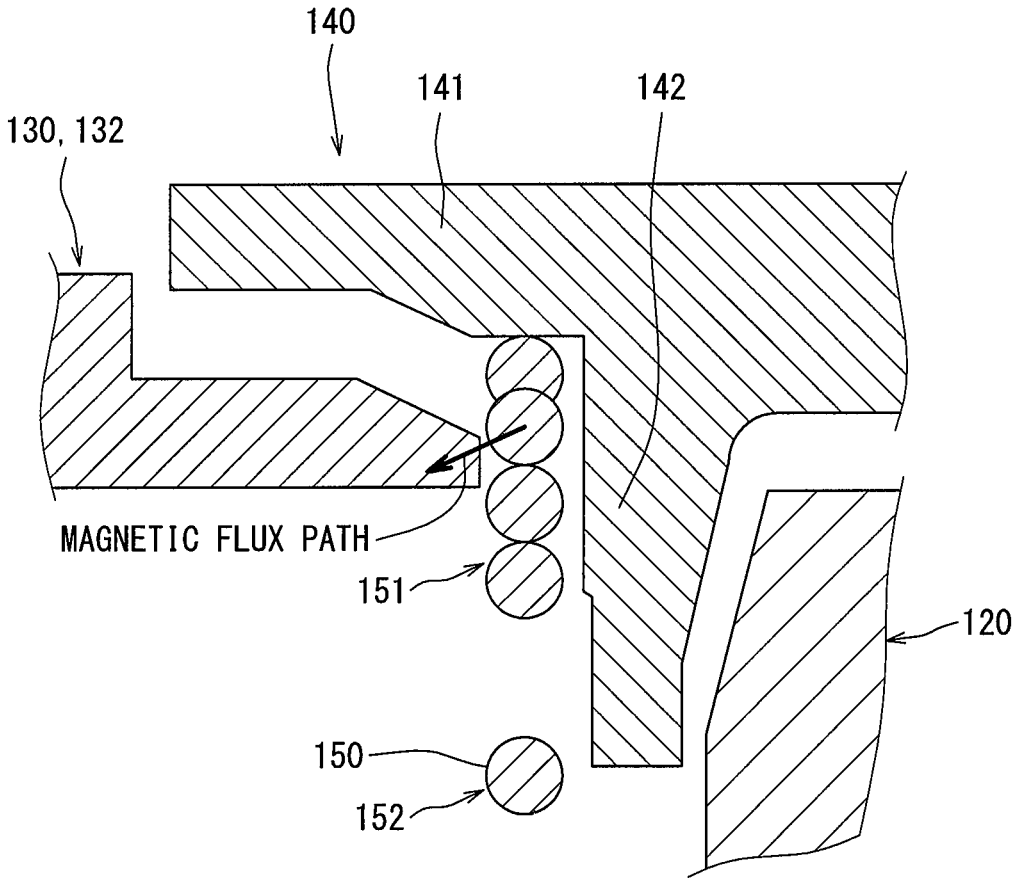
FIG. 9 is an enlarged view showing a portion IX in FIG. 7B.

However, as shown in FIG. 9, in the region 151 having the small pitch of the return spring 150, there is a diagonally downward magnetic flux path in which sparse portions and dense portions are formed over the entire area in the circumferential direction by regions having a substantive of the return spring 150 and regions having no substantive of the return spring 150. Therefore, a downward (axis line direction) attractive force is obtained as a component force by the obliquely downward magnetic flux path, which leads to an improvement in the attractive force.

Fifth Embodiment

Figure 10:
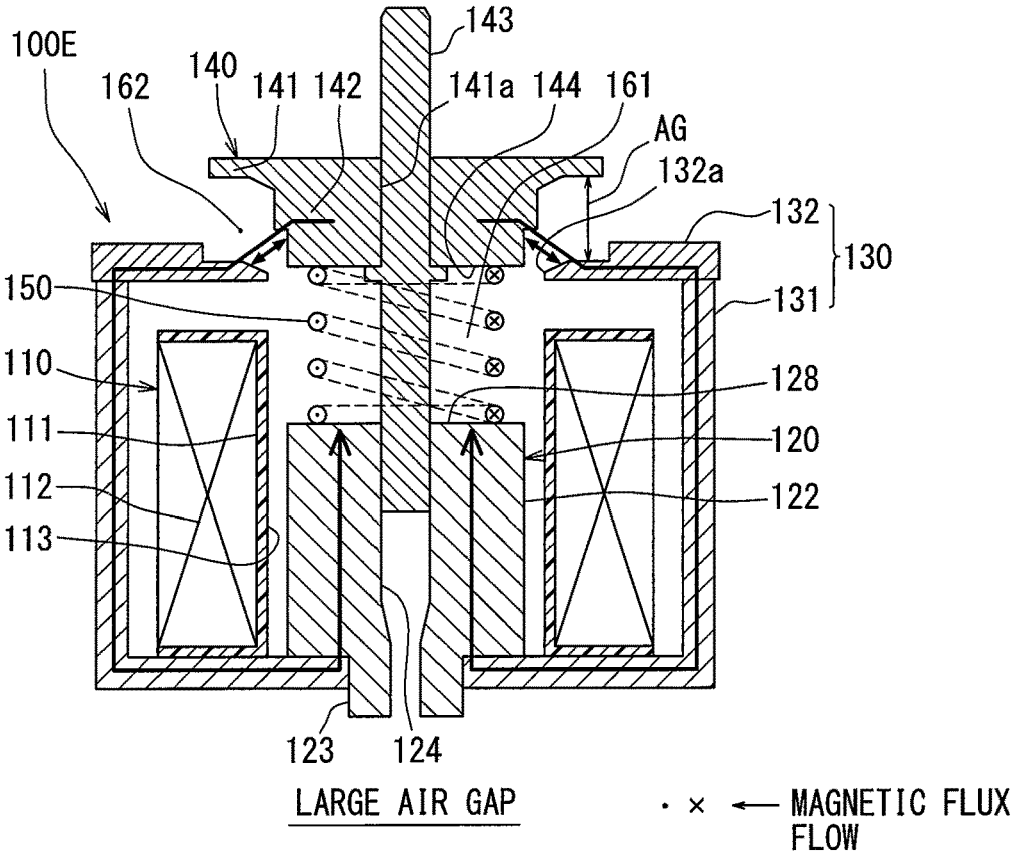
FIG. 10 is a cross-sectional view showing an electromagnetic relay (large air gap) according to a fifth embodiment.
Figure 11:
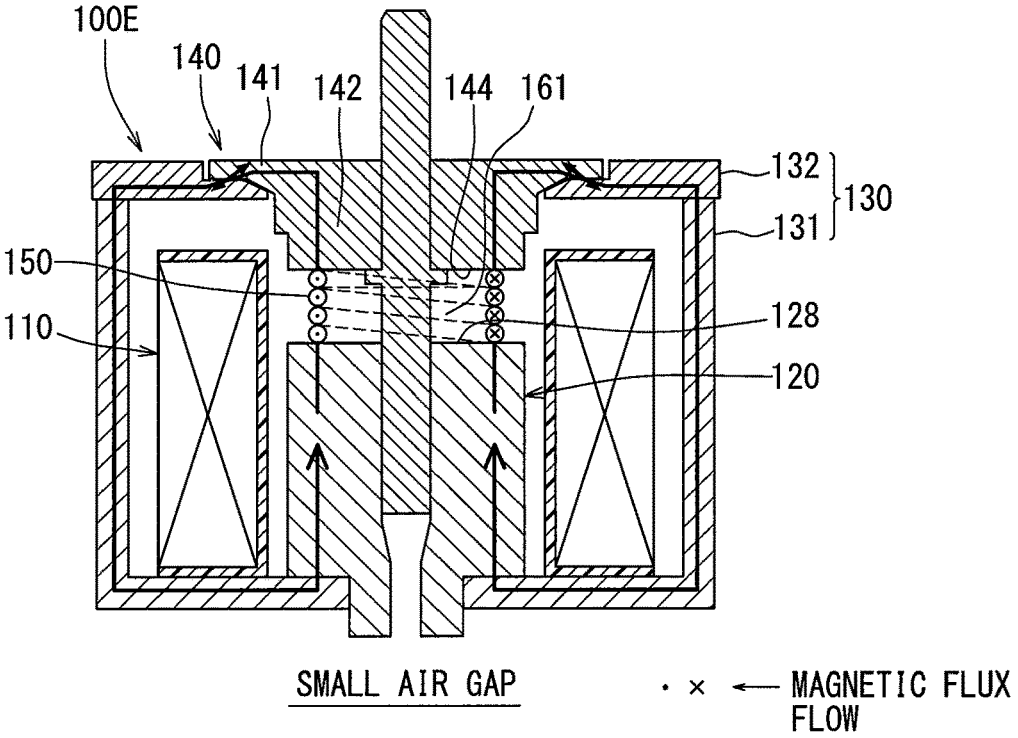
FIG. 11 is a cross-sectional view showing the electromagnetic relay (small air gap) according to the fifth embodiment.

An electromagnetic relay 100E according to a fifth embodiment is shown in FIGS. 10 and 11. In the fifth embodiment, shapes of a stationary core 120 and a movable core 140 are changed and placement of a return spring 150 is changed as compared with the first embodiment.

The stationary core 120 excludes the tapered portion 121, the stopper portion 125, the recess portion 126, and the protrusion portion 127 described in the first embodiment, and includes a circular portion 122, a small diameter portion 123, and a center hole 124. A surface of the stationary core 120 facing the movable core 140 on one side in the axis line direction is a flat facing surface 128.

The movable core 140 excludes the tapered portion 142*a* and the cylindrical portion 142*b* in the protrusion portion 142 described in the first embodiment, and the protrusion portion 142 is formed in a flat columnar shape. A surface (facing surface) of the movable core 140 facing the stationary core 120 on the other side in the axis line direction is a flat facing surface 144.

Similarly to the first embodiment, a space between the stationary core 120 (facing surface 128) and the movable core 140 (facing surface 144) is defined as a first gap 161, and a space between the movable core 140 and the yoke 130 (second yoke 132) is defined as a second gap 162.

The return spring 150 is placed so as to magnetically bridge the stationary core 120 and the movable core 140 in the first gap 161. In other words, the respective end sides of the return spring 150 are placed so as to come in contact with the facing surfaces 128 and 144.

At the time of deenergization, the other end (facing surface 144) of the movable core 140 in the axis line direction, which is urged by the return spring 150, is set to a position equivalent to the position of the second yoke 132.

A portion between a plate portion 141 of the movable core 140 and the second yoke 132 of the yoke 130 corresponds to an air gap AG.

As shown in FIG. 11, a distance (a distance of the first gap 161 in the axis line direction) between the stationary core 120 and the movable core 140 when the movable core 140 is attracted to the stationary core 120 side (when the air gap AG is zero in the attracted state) at the time of energization is set to be equal to a minimum length when the return spring 150 is shortened to the maximum.

Also in the present embodiment, similarly to the first embodiment, the attractive force of the movable core 140 toward the stationary core 120 can be improved.

In other words, when the exciting coil 110 is energized (at the time of energization), a magnetic field is developed between the stationary core 120 and the movable core 140 and between the movable core 140 and the yoke 130 by the exciting coil 110.

In this example, since the return spring 150 is made of a magnetic material and is placed so as to magnetically bridge the first gap 161 (between the stationary core 120 and the movable core 140), the magnetic flux flows spirally along the return spring 150. Then, the generation of the attractive force at the time of energization in the first gap 161 is reduced.

However, the magnetoresistance in the first gap 161 can be reduced by the return spring 150 made of a magnetic material, and a total magnetic flux passing through the stationary core 120, the movable core 140, and the yoke 130 can be increased when the exciting coil 110 is energized.

As the total magnetic flux increases, the attractive force generated in the second gap 162, that is, a force of the component of the attractive force in the axis line direction as indicated by both arrows in FIGS. 10 and 11 (an attractive force in a direction to attract the movable core 140 toward the stationary core 120 side) can be increased. In general, the increased attractive force can improve the attractive force acting on the movable core 140 toward the stationary core 120.

Sixth Embodiment

Figure 12:
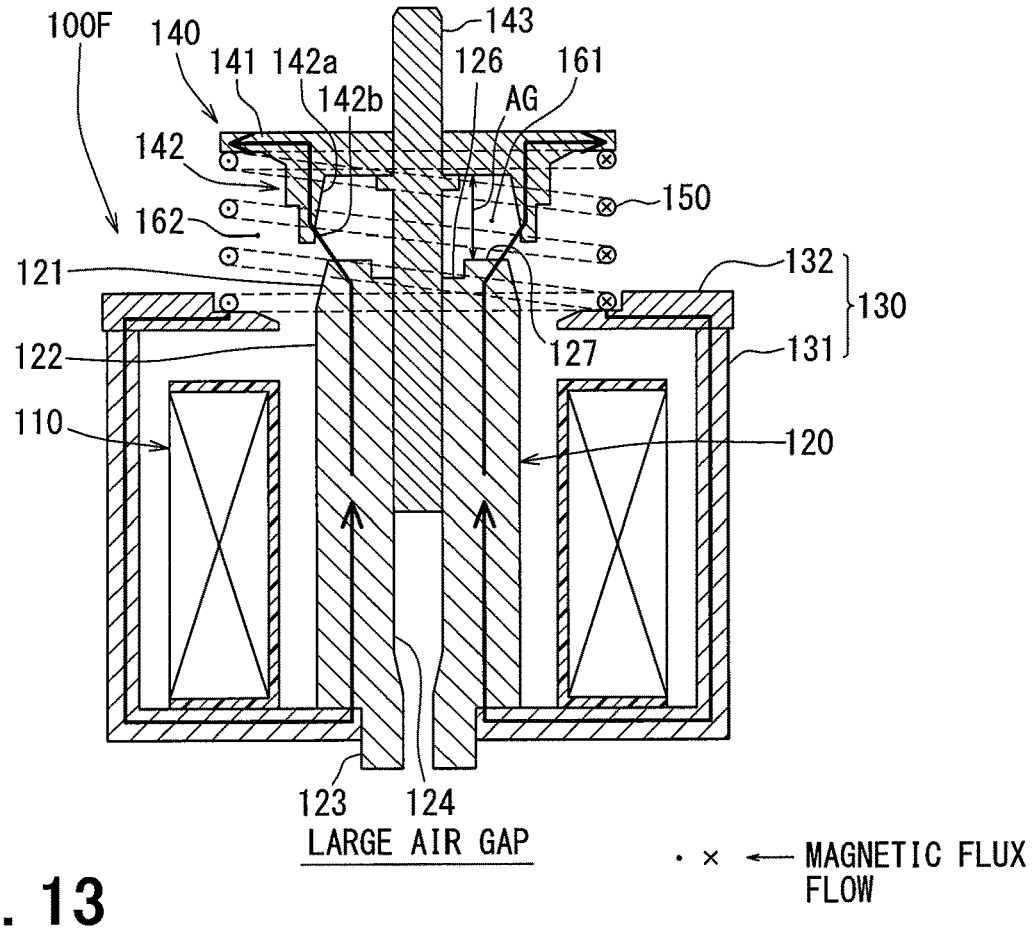
FIG. 12 is a cross-sectional view showing an electromagnetic relay (large air gap) according to a sixth embodiment.
Figure 13:
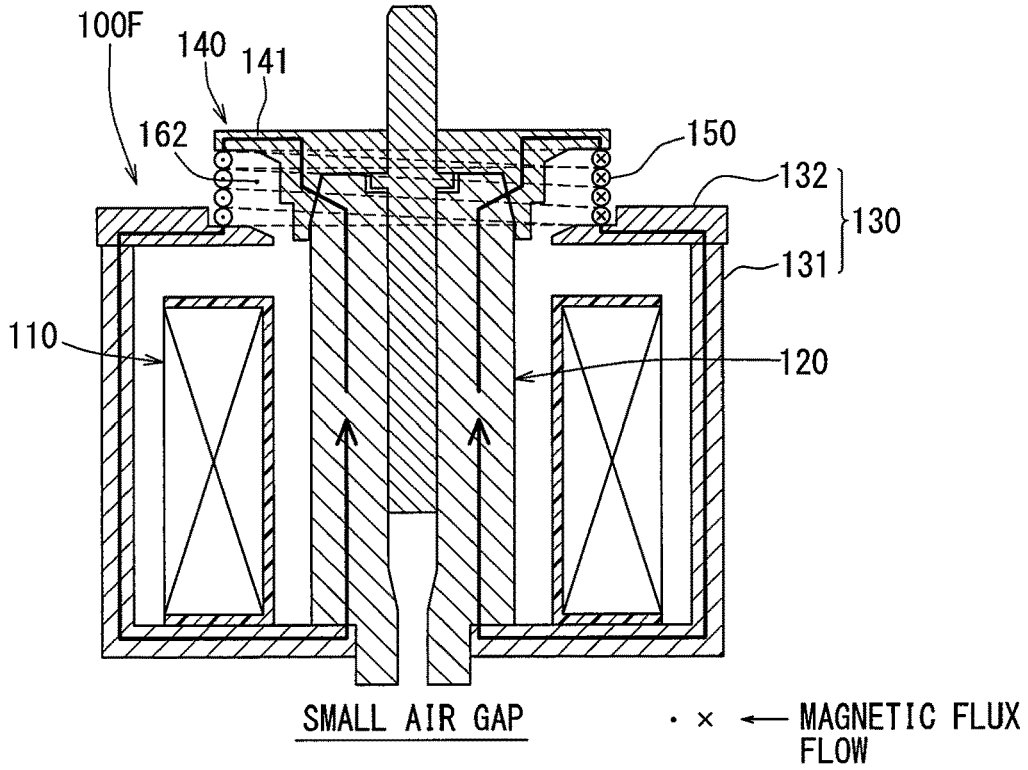
FIG. 13 is a cross-sectional view showing the electromagnetic relay (small air gap) according to the sixth embodiment.

An electromagnetic relay 100F according to a sixth embodiment is shown in FIGS. 12 and 13. In the sixth embodiment, a shape of a stationary core 120 is changed and the placement of a return spring 150 is changed as compared with the first embodiment.

The stationary core 120 excludes the stopper 125 described in the first embodiment.

Like the first embodiment, a gap between the stationary core 120 and a movable core 140 is defined as a first gap 161, and a gap between movable core 140 and a yoke 130 (second yoke 132) is defined as a second gap 162.

The return spring 150 is placed so as to magnetically bridge the yoke 130 and the movable core 140 in the second gap 162. In other words, the respective end sides of the return spring 150 is placed so as to be in contact with the second yoke 132 and a plate portion 141.

At the time of deenergization, an air gap AG is defined between a protrusion portion 127 of the stationary core 120 and the plate portion 141 of the movable core 140.

As shown in FIG. 13, a distance (a distance of the second gap 162 in the axis line direction) between the yoke 130 (the second yoke 132) and the movable core 140 (the plate portion 141) when the movable core 140 is attracted to the stationary core 120 side (when the air gap AG is zero) at the time of energization is set to be equal to the minimum length when the return spring 150 is shortened to the maximum.

In the present embodiment, when the exciting coil 110 is energized (at the time of energization), a magnetic field is developed between the stationary core 120 and the movable core 140 and between the movable core 140 and the yoke 130 by the exciting coil 110.

In this example, since the return spring 150 is made of a magnetic material and is placed so as to magnetically bridge the second gap 162 (between the yoke 130 and the movable core 140), the magnetic flux flows spirally along the return spring 150. Then, the generation of the attractive force at the time of energization in the second gap 162 is reduced.

However, a magnetoresistance in the second gap 162 can be reduced by the return spring 150 made of the magnetic material, and the total magnetic flux passing through the stationary core 120, the movable core 140, and the yoke 130 can be increased when the exciting coil 110 is energized.

As the total magnetic flux increases, the attractive force generated in the first gap 161, that is, the attractive force in the direction in which the movable core 140 is attracted toward the stationary core 120 can be increased. In general, this increased attractive force can improve the attractive force acting on the movable core 140 toward the stationary core 120.

Seventh Embodiment

Figure 14:
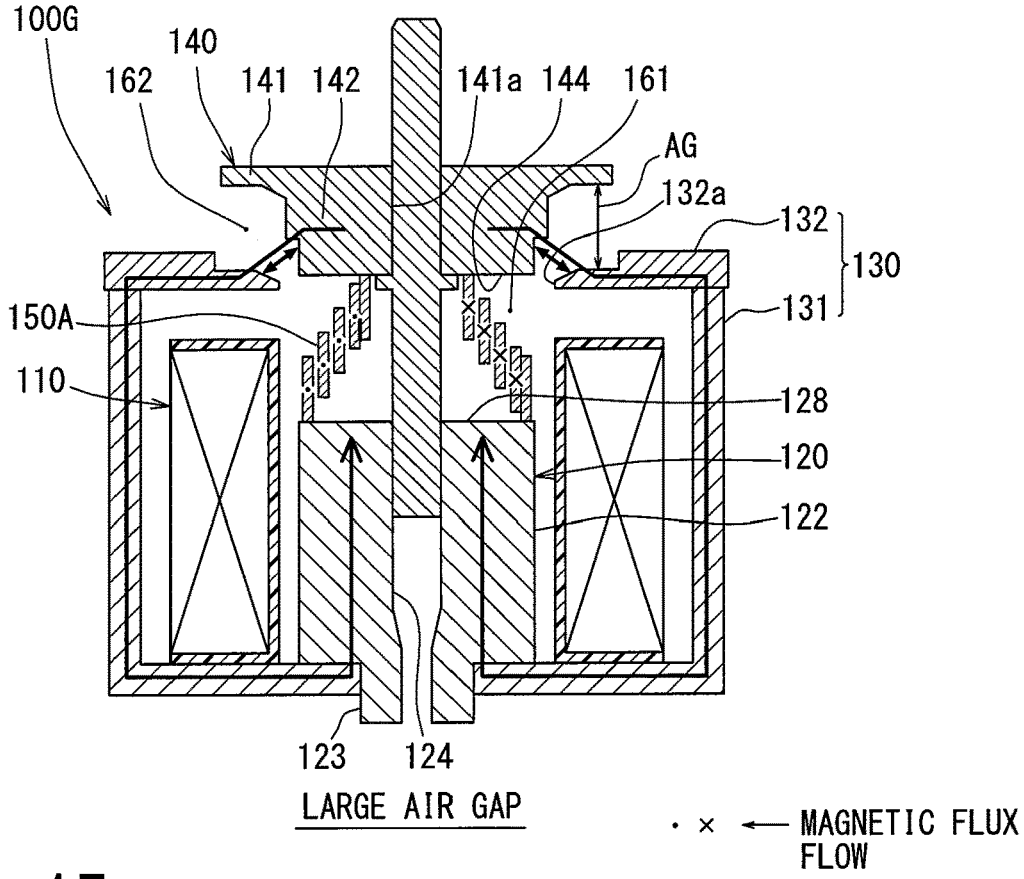
FIG. 14 is a cross-sectional view showing an electromagnetic relay (large air gap) according to a seventh embodiment.
Figure 15:
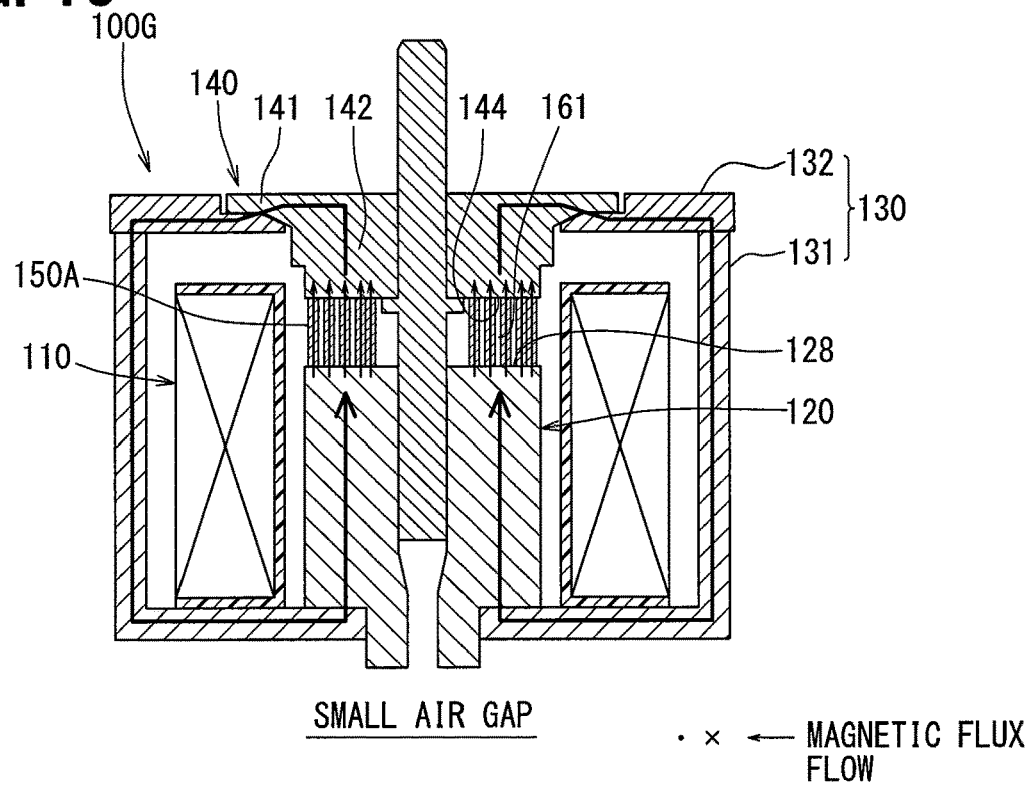
FIG. 15 is a cross-sectional view showing an electromagnetic relay (small air gap) according to the seventh embodiment.

An electromagnetic relay 100G according to a seventh embodiment is shown in FIGS. 14 and 15. In the seventh embodiment, a return spring 150A is changed as compared with the fifth embodiment.

The return spring 150A is a conical spring in which a strip-shaped thin-walled plate member is wound in a conical shape. The conical spring, which is made of the band-shaped thin plate material, is called a volute spring. The return spring 150A is placed so as to magnetically bridge a stationary core 120 and a movable core 140 in a first gap 161. In other words, the respective end sides of the return spring 150A in the axis line direction are placed so as to be in contact with facing surfaces 128 and 144. The end of the return spring 150A corresponding to a conical bottom surface side is in contact with the facing surface 128. The end of the return spring 150A corresponding to a conical apex side is in contact with the facing surface 144.

At the time of deenergization, the other end (facing surface 144) of the movable core 140, which is urged by the return spring 150A, in the axis line direction, is set to a position equivalent to the position of the second yoke 132. A portion between a plate portion 141 of the movable core 140 and the second yoke 132 of the yoke 130 corresponds to an air gap AG.

As shown in FIG. 15, a distance (a distance in the axis line direction of the first gap 161) between the stationary core 120 and the movable core 140 when the movable core 140 is attracted to the stationary core 120 side (when the air gap AG is zero) at the time of energization is set to be equal to a length (minimum length) of the return spring 150A in the axis line direction when the return spring 150A is maximally contracted and formed into a cylindrical shape.

Also in the present embodiment, similarly to the fifth embodiment, the attractive force generated in the second gap 162 can be increased to improve the attractive force of the movable core 140 toward the stationary core 120.

In addition, according to the present embodiment, a volute spring is used as the return spring 150A. In the volute spring, at the time of energization, a force for contracting the spring can be obtained by generating an attractive force between the stationary core 120 and the return spring 150A and between the movable core 140 and the return spring 150A by a leakage magnetic flux generated between the winding of the volute spring and the facing surface 128 and a leakage magnetic flux generated between the winding of the volute spring and the facing surface 144. Therefore, the apparent spring reaction force of the return spring 150A can be weakened, and a relative attractive force of the movable core 140 to the stationary core 120 side can be increased.

As shown in FIG. 15, when the air gap AG becomes zero at the time of energization, the return spring 150A is contracted as if the return spring 150A had a cylindrical shape in the first gap 161. At that time, a magnetic flux passing through the return spring 150A flows along the cylindrical axis line direction and has no component in the radial direction. Therefore, the magnetic flux causing a loss when a force in the axis line direction for attracting the movable core 140 is generated can be reduced.

Eighth Embodiment

Figure 16:
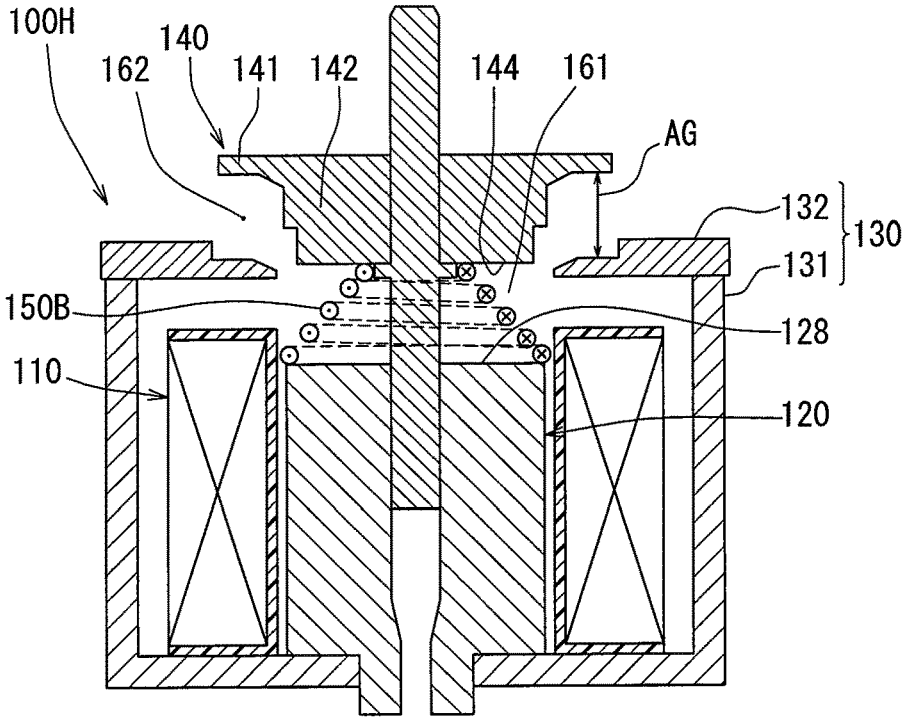
FIG. 16 is a cross-sectional view showing an electromagnetic relay (large air gap) according to an eighth embodiment.
Figure 17:
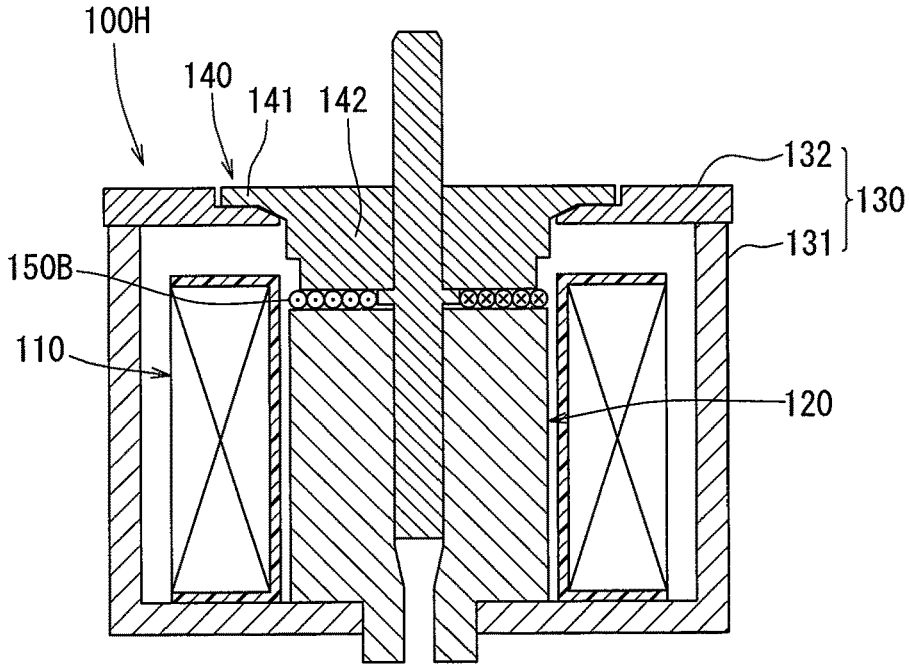
FIG. 17 is a cross-sectional view showing the electromagnetic relay (small air gap) according to the eighth embodiment.

An electromagnetic relay 100H according to an eighth embodiment is shown in FIGS. 16 and 17. In the eighth embodiment, a return spring 150A is changed to a return spring 150B as compared with the seventh embodiment.

The return spring 150B is a conical spring in which a linear material having a circular cross section is wound conically. The conical spring made of the linear material is so-called a conical coil spring. Similar to the seventh embodiment, the return spring 150B is placed so as to magnetically bridge a stationary core 120 and a movable core 140 in a first gap 161. In other words, the respective ends of the return spring 150B in the axis line direction are placed so as to be in contact with facing surfaces 128 and 144. The end of the return spring 150B corresponding to a conical bottom surface side is in contact with the facing surface 128. The end of the return spring 150B corresponding to a conical apex side is in contact with the facing surface 144.

At the time of deenergization, the other end (facing surface 144) of the movable core 140, which is urged by the return spring 150B, in the axis line direction, is set to a position equivalent to the position of the second yoke 132. A portion between a plate portion 141 of the movable core 140 and the second yoke 132 of the yoke 130 corresponds to an air gap AG.

As shown in FIG. 17, a distance (a distance in the axis line direction of the first gap 161) between the stationary core 120 and the movable core 140 when the movable core 140 is attracted to the stationary core 120 side (when the air gap AG is zero) at the time of energization is set to be equal to a length (minimum length) of the return spring 150B in the axis line direction when the return spring 150B is maximally contracted and formed into a disk shape.

Also in the present embodiment, similarly to the first and seventh embodiments, the attractive force of the movable core 140 to the stationary core 120 side can be improved, the spring force can be weakened, and the magnetic flux that causes loss can be reduced.

In particular, in the return spring 150B, since the length (minimum length) of the return spring 150A when shortened to the maximum can be set to be smaller than that of the return spring 150A in the seventh embodiment, and a distance between the stationary core 120 and the movable core 140 can be reduced, the magnetoresistance during attraction (the air gap AG is zero) can be reduced to enhance the attractive force.

The return spring 150B may use a rectangular wire having a square cross section as a linear material. In that case, as compared with the case of the above-mentioned circular cross-section, an area of the return spring 150B facing the stationary core 120 and the movable core 140 while the return spring is being contracted, and an area of the return spring 150B which is in contact with the stationary core 120 and the movable core 140 when the return spring reaches the minimum length can be increased, so that the magnetoresistance can be lowered and the attractive force can be further increased.

Ninth Embodiment

An electromagnetic relay according to a ninth embodiment of the present disclosure will be described with reference to FIG. 18.

Figure 18:
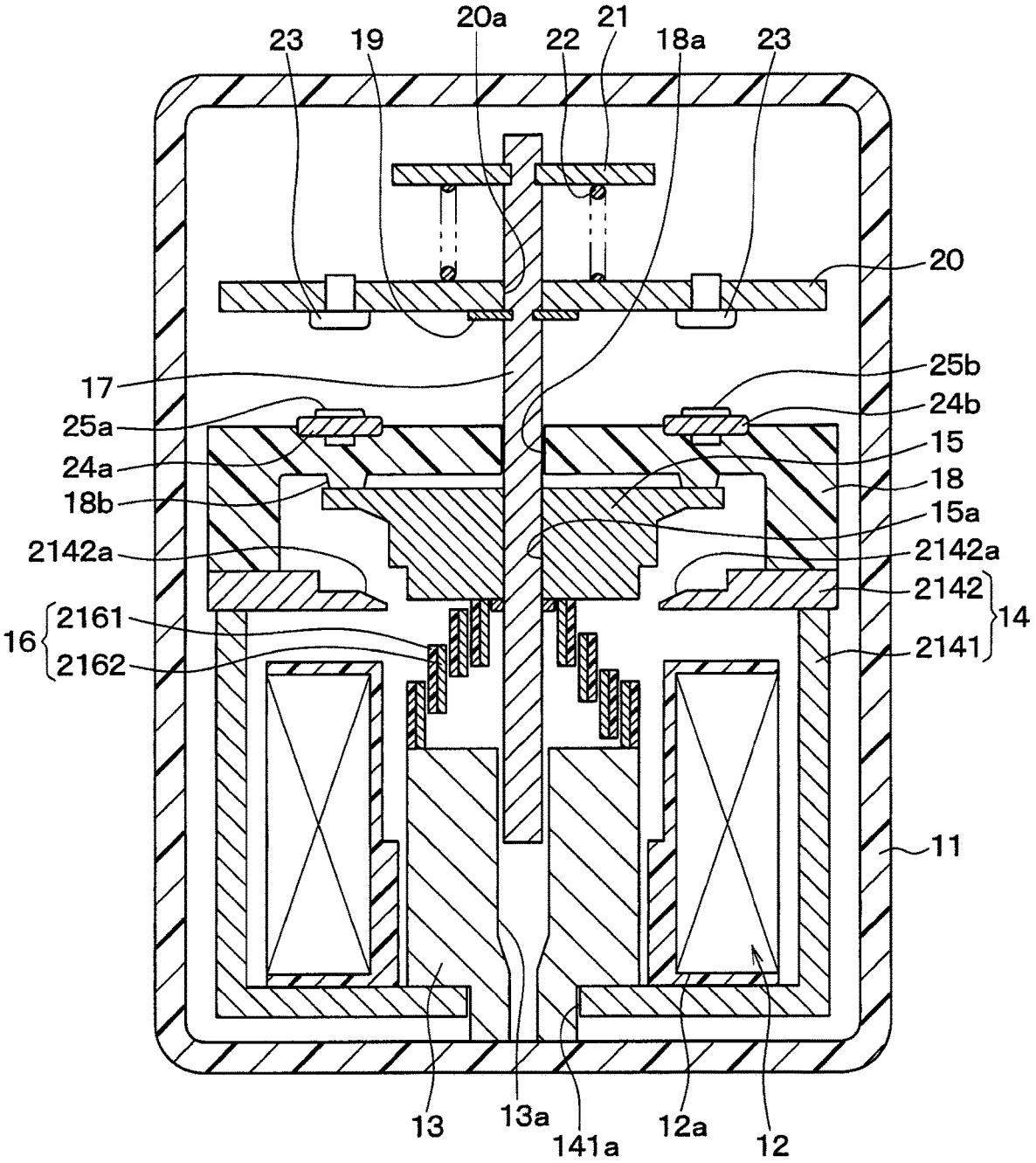
FIG. 18 is a cross-sectional view of an electromagnetic relay according to a ninth embodiment.

As shown in FIG. 18, the electromagnetic relay includes a case 11, an exciting coil 12, a stationary core 13, a yoke 14, a movable core 15, a return spring 16, a shaft 17, a base 18, a retaining ring 19, a movable contact 20, a retaining ring 21, and a contact pressure spring 22.

The case 11 is made of a non-magnetic and non-conductive material such as resin, for example. Each component forming the electromagnetic relay is accommodated in a space defined in the case 11.

The exciting coil 12 forms a magnetic field at the time of energization, and is formed in a cylindrical shape and wound around a bobbin 12*a* having a hollow cylindrical portion. The exciting coil 12 is energized through an external connection terminal (not shown). The stationary core 13 and the like are placed in a center hole formed in an inner diameter portion of the exciting coil 12.

The stationary core 13 is made of a magnetic material, is formed of a columnar member having a size corresponding to the center hole of the exciting coil 12, and forms a part of a magnetic circuit. The stationary core 13 has a structure in which a through hole 13*a* is provided along the center axis, and one end of the shaft 17 is located in the through hole 13*a*.

The yoke 14 is formed of a magnetic member surrounding the exciting coil 12. The yoke 14 is placed so as to cover one of an outer peripheral side and an end in the axial direction of the exciting coil 12, forms a part of a magnetic circuit, and provides a yoke hole 2142*a* which is an opening portion corresponding to the position of the stationary core 13 on one side in the axial direction.

In the present embodiment, the yoke 14 has a first member 2141 and a second member 2142. The first member 2141 is a member called a stationary and an outer peripheral side of the exciting coil 12 and one end side of the exciting coil 12 in the axial direction are covered with the first member 2141 having a structure in which a plate member made of a magnetic material is bent into a substantially U-shape. The second member 2142 is a member called a top plate, is made of a magnetic material, is formed in a circular flat plate shape or a rectangular flat plate shape, and covers the other end side of the exciting coil 12 in the axial direction. The second member 2142 is placed so as to face the movable core 15, which will be described later, and is joined to the first member 2141.

An opening portion 141*a* is provided in the first member 2141 at a position corresponding to the stationary core 13, and a part of the stationary core 13 is fitted into the opening portion 141*a* to join the stationary core 13 and the first member 2141. In the second member 2142, the yoke hole 2142*a* is formed at the center so as to penetrate through the second member 2142. The shape of the yoke hole 2142*a*, that is, the inner peripheral shape of the second member 2142 is shaped to correspond to the movable core 15.

The movable core 15 is a plate-like member made of a magnetic material and placed at a position corresponding to the yoke hole 2142*a* in the second member 2142. A through hole 15*a* into which a shaft 17 to be described later is inserted is provided on the center axis of the movable core 15. The movable core 15 is located at a rest position away from the yoke 14 at the time of deenergization when the exciting coil 12 is not energized, and is magnetically attracted to the yoke 14 side and brought into contact with the second member 2142 of the yoke 14 at the time of energization when the exciting coil 12 is energized. The outer peripheral shape of the movable core 15 is a shape corresponding to the inner peripheral shape of the yoke hole 2142*a*, and a side opposite to the stationary core 13 is a flange shape having a diameter larger than that of the stationary core 13 side, and the flange-shaped portion is brought into contact with the yoke hole 2142*a*.

The return spring 16 is placed between the stationary core 13 and the movable core 15, and urges the movable core 15 to the side opposite to the stationary core 13. At the time of energization when the exciting coil 12 is energized, the movable core 15 is attracted to the stationary core 13 side against the return spring 16 by an electromagnetic attractive force. The return spring 16 is formed of multiple springs, and at least one of the springs is made of a magnetic material. The detailed structure of the return spring 16 will be described later.

In this way, at least part of the stationary core 13, the yoke 14, the movable core 15, and the return spring 16 are made of a magnetic material, and at the time of energization when the exciting coil 12 is energized, a magnetic circuit of magnetic flux induced by the magnetic coil 12 is configured by the energization.

The shaft 17 is made of, for example, a non-magnetic material, and can move integrally with the movable core 15 by being coupled to the movable core 15. More specifically, the shaft 17 is coupled to the movable core 15 in a state of being inserted into the through hole 15*a* provided in the movable core 15.

In the case of the present embodiment, the movable core 15, the shaft 17, the movable contactor 20, and the like are moved forward and backward on energization and deenergization of the exciting coil 12. Those movable parts configure a mover.

The base 18 is made of a non-magnetic insulating material, for example, a resin. An opening portion 18*a* is provided in the center of the base 18, and the shaft 17 is inserted into the opening portion 18*a*. The base 18 is fixed to the case 11 in a state of contact with the yoke 14. The base 18 is provided with a first fixed terminal 24*a* and a second fixed terminal 24*b* which are formed in a plate shape and made of a conductive metal. The first fixed terminal 24*a* and the second fixed terminal 24*b* configure a part of wiring of an electric circuit to be subjected to on/off control by the electromagnetic relay. Further, a first fixed contact 25*a* is attached to the base 18 so as to be connected to the first fixed terminal 24*a*, and a second fixed contact 25*b* is attached so as to be connected to the second fixed terminal 24*b*. The first fixed contact 25*a* is placed to face one movable contact element 23, and the second fixed contact 25*b* is placed to face the other movable contact element 23.

A stopper 18*b* is provided on one surface of the base 18 facing the movable core 15, and restricts the movement of the movable core 15 to a side opposite to the stationary core 13.

The retaining ring 19 is placed on a side of the shaft 17 opposite to the stationary core 13 with respect to the base 18, and is fixed by being fitted to the shaft 17. The retaining ring 19 positions the movable contact 20 in the axial direction of the shaft 17.

The movable contact 20 is formed of a plate-like member made of a conductive metal, and two movable contacts 23 made of a conductive metal are fixed at symmetrical positions around, for example, the shaft 17. When the shaft 17 is inserted into the insertion hole 20*a* provided in the center, the movable contact 20 is placed on a side of the shaft 17 opposite to the stationary core 13 with respect to the base 18 together with the retaining ring 19. One surface of the movable contact 20 on the stationary core 13 side is in contact with the retaining ring 19, and the movable contact 20 is positioned and placed at the position of the retaining ring 19.

The retaining ring 21 is fitted to an end of the shaft 17 opposite to the stationary core 13. The contact pressure spring 22 is placed between the retaining ring 21 and the movable contact 20, and urges the movable contact 20 toward the retaining ring 19, that is, toward the first fixed contact 25*a* and the second fixed contact 25*b*. For that reason, even if vibration or the like occurs, the connection between the movable contact element 23 and the first fixed contact 25*a*, the second fixed contact 25*b* is maintained.

The electromagnetic relay according to the present embodiment is configured by the structure described above. In the electromagnetic relay configured as described above, the return spring 16 is configured as follows.

The return spring 16 is formed of multiple springs, and in the present embodiment, is formed of two types of springs. For that reason, a part of the multiple springs mainly serves to adjust a spring force of a separation spring for urging the movable core 15, the shaft 17, and the like in the non-attraction direction, and another part mainly serves to form the magnetic circuit.

Specifically, the return spring 16 is configured to include a first spring 2161 made of a magnetic material and a second spring 2162 made of a non-magnetic material. The first spring 2161 is formed of a conical compression coil spring called a volute spring formed by spirally winding a thin plate, and is made of a magnetic material. The second spring 2162 is also formed of a conical compression coil spring called a volute spring, and is made of a non-magnetic material. For example, SPCC (cold-rolled steel sheet), SK, SUS430, or the like can be used as the magnetic material forming the first spring 2161. As the non-magnetic material forming the second spring 2162, SUS304 or the like can be used.

In the case of the present embodiment, the return spring 16 in which the first spring 2161 and the second spring 2162 are integrated together is made of a plywood in which the magnetic body and the non-magnetic body are combined together. The first spring 2161 is placed on an inner peripheral side and the second spring 2162 is placed on an outer peripheral side, and the second spring 2162 is placed between the respective windings of the first spring 2161. In the case of the present embodiment, the return spring 16 is placed between the movable core 15 and the stationary core 13 such that a tip of the return spring 16 on a smaller diameter side is directed toward the movable core 15 side and a distal end of the return spring 16 on a larger diameter side is directed toward the stationary core 13 side. The first spring 2161 is in contact with both the movable core 15 and the stationary core 13.

In such a configuration, the first spring 2161 can mainly serve to form the magnetic circuit, and the second spring 2162 can mainly serve to adjust the spring force of the separation spring for urging the movable core 15, the shaft 17, and the like in the non-attraction direction.

Next, the operation of the electromagnetic relay according to the present embodiment will be described with reference to FIGS. 19A to 19C. Incidentally, solid line arrows shown in FIGS. 19A to 19C and direction indication symbols denoted on the first spring 2161 indicate directions of flow of the magnetic flux, and broken line arrows indicate directions of the magnetic attraction.

First, at the time of deenergization when the exciting coil 12 is not energized, as shown in FIG. 18, since the magnetic attraction force by the exciting coil 12 is not generated, the movable core 15 is separated from the stationary core 13 based on the spring force of the return spring 16. The movable contact element 23 is also separated from the first fixed contact 25*a* and the second fixed contact 25*b*. For that reason, the electric circuit to be controlled to be turned on/off by the electromagnetic relay is turned off.

Figure 19A:
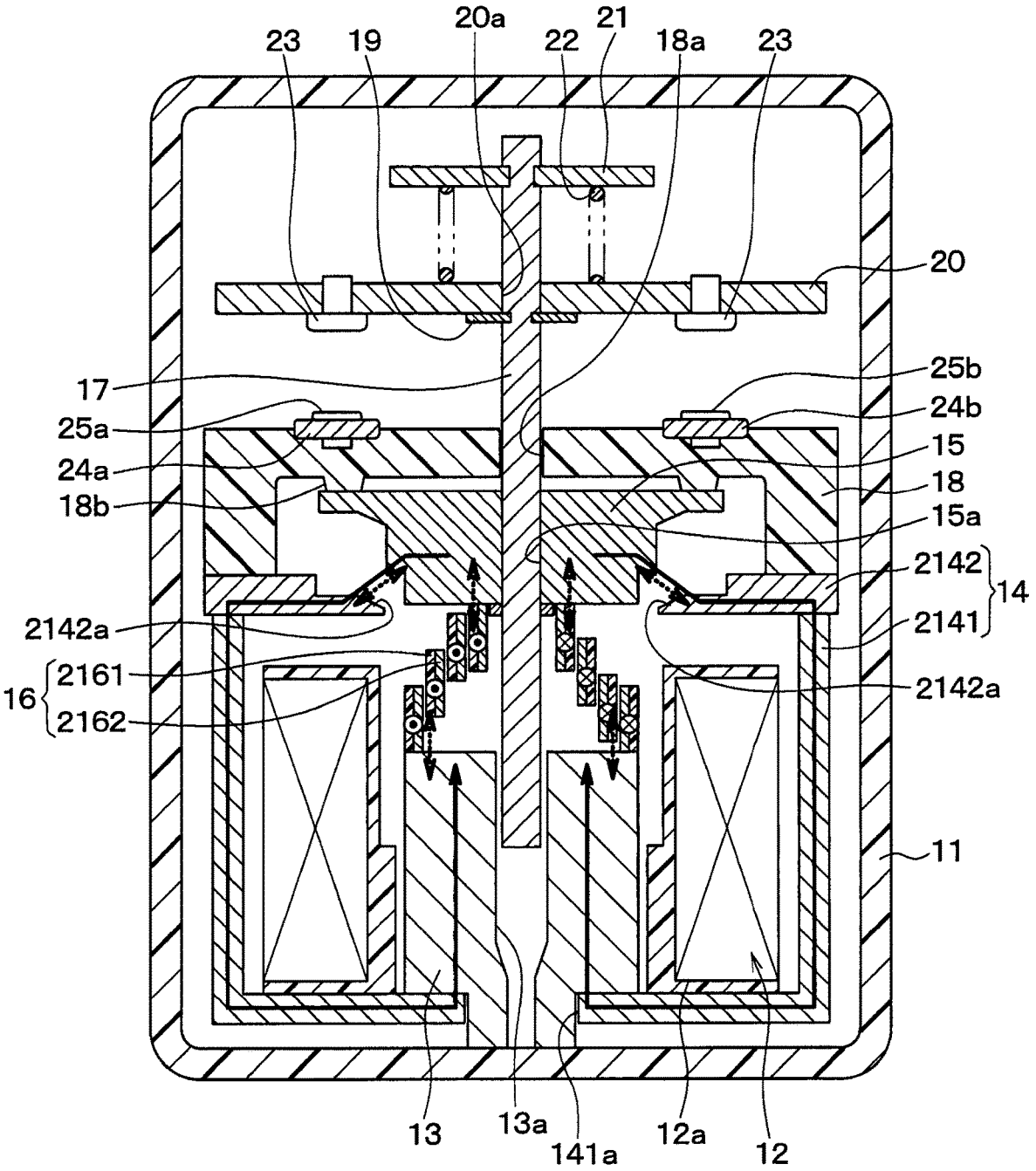
FIG. 19A is a cross-sectional view of the electromagnetic relay shown in FIG. 18 when the energization of an exciting coil is started.
Figure 19B:
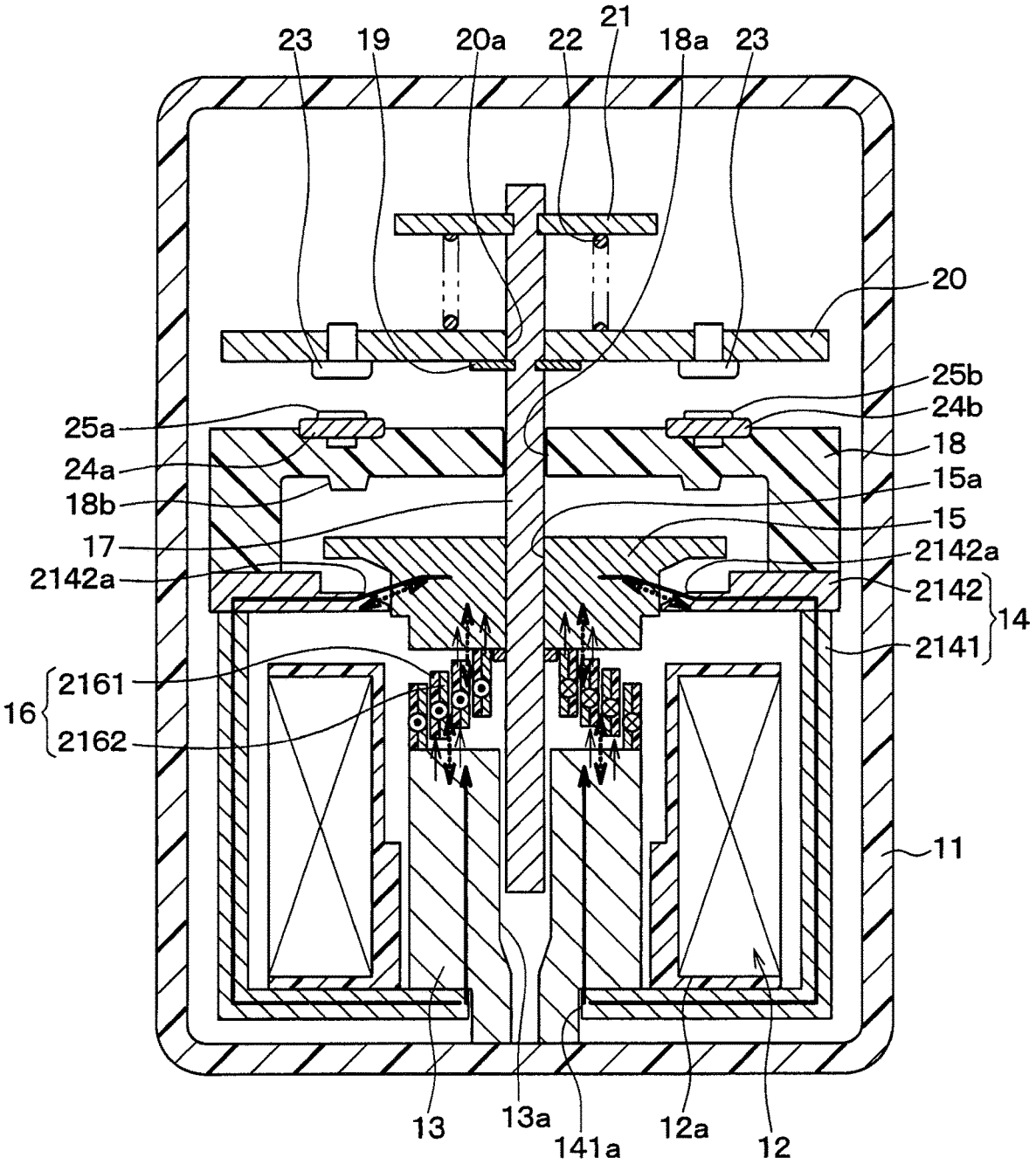
FIG. 19B is a cross-sectional view showing a state of the electromagnetic relay shown in FIG. 18 while the exciting coil is being energized toward a conductive state.
Figure 19C:
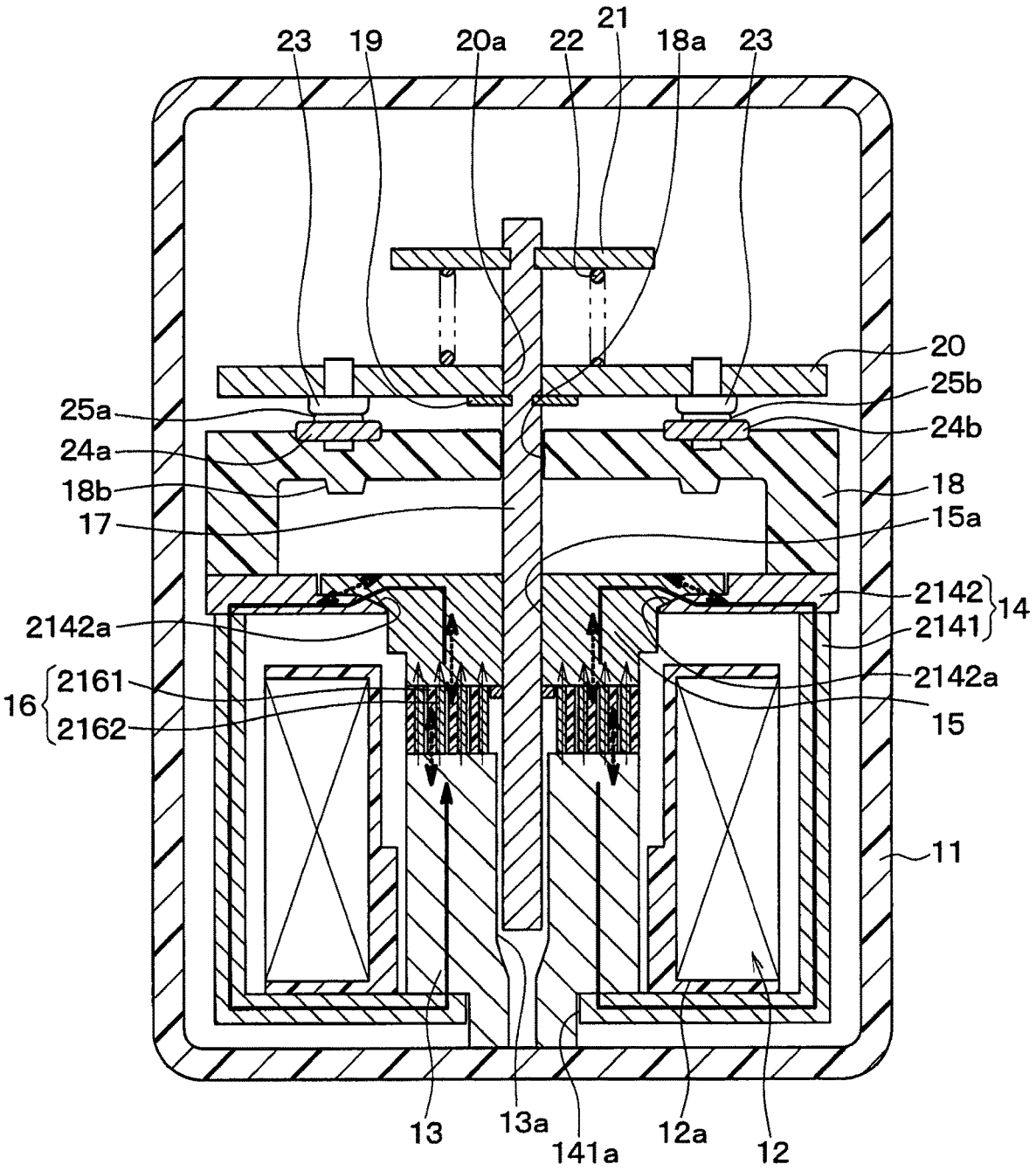
FIG. 19C is a cross-sectional view showing a state of the electromagnetic relay shown in FIG. 18 when the exciting coil has been energized into the conductive state.

When the exciting coil 12 is energized, as shown in FIGS. 19A and 19B, the movable core 15 is attracted to the stationary core 13 side against the return spring 16 by the electromagnetic attractive force, and the shaft 17 and the movable contact 20 move to the stationary core 13 side following the movable core 15. As shown in FIG. 19C, the movable contact element 23 comes into contact with the first fixed contact 25*a* and the second fixed contact 25*b*, and the first fixed contact 25*a* and the second fixed contact 25*a* are electrically connected to each other.

The thickness of the first spring 2161 in the axial direction of the return spring 16 is arbitrary, but it is preferable that the first spring 2161 has such a thickness that the first spring 2161 is brought in contact with both of the movable core 15 and the stationary core 13 when the first fixed contact 25*a* and the second fixed contact 25*a* are electrically connected to each other. In this manner, a magnetic circuit is formed between the movable core 15 and the stationary core 13 over the entire winding area of the first spring 2161, and the conductive state can be maintained in a state in which the movable core 15 is magnetically attracted more strongly.

On the other hand, when the energization of the exciting coil 12 is released, the movable core 15, the shaft 17, and the movable contact 20 are urged by the return spring 16 to move to the opposite side of the stationary core 13. As a result, as shown in FIG. 18, the movable contact element 23 is separated from the first fixed contact 25*a* and the second fixed contact 25*b*, and the first fixed contact 25*a* and the second fixed contact 25*b* are electrically disconnected from each other.

In this example, in order to cause the return spring 16 to function as a part of the magnetic circuit when performing the above operation, at least a part of the return spring 16 is made of a magnetic material, and in the case of the present embodiment, the first spring 2161 is made of a magnetic material.

However, as long as at least a part of the return spring 16 is made of a magnetic material, a force (hereinafter referred to as a side force) is generated between the return spring 16 and other magnetic material components, which causes an inclination of the movable core 15 and the return spring 16. For that reason, it is preferable that at least a part of the return spring 16 is made of a magnetic material and used as a magnetic circuit, while the side force can be reduced.

For that reason, in the present embodiment, the first spring 2161 is formed of a conical compression coil spring called a volute spring.

When the movable core 15 is magnetically attracted to the stationary core 13 side on energization of the exciting coil 12, a magnetic flux flows along the winding of the first spring 2161 formed of the volute spring. At this time, since the first spring 2161 has a thin plate shape, a leakage magnetic flux from the first spring 2161 is generated between the stationary core 13 and the first spring 2161, and between the first spring 2161 and the movable core 15. With the use of the leakage magnetic flux, a magnetic attraction force can be generated between the stationary core 13 and the first spring 2161, and between the first spring 2161 and the movable core 15 to obtain a "force for contracting the spring". That is, an apparent spring reaction force can be weakened only while the exciting coil 12 is energized.

When the movable core 15 is completely attracted, the magnetic flux flows in a height direction of the first spring 2161, but the attractive force acting on the movable core 15 and the first spring 2161 has no radial component from the start of magnetic attraction to the end of attraction of the movable core 15. This makes it possible to reduce the side force. As described above, since the side force can be reduced by applying the volute spring as the first spring 2161 of the return spring 16, the inclination of the movable core 15 and the return spring 16 can be reduced.

However, when the entire return spring 16 is formed of volute springs which are made of a magnetic material, in other words, the return spring 16 is formed of only the first spring 2161, a gap between the respective windings of the first spring 2161 changes in accordance with the operation of the movable core 15, which may cause a frictional force to increase. In other words, although it is preferable that a constant gap is secured between the respective windings of the first spring 2161, a gap between the first springs 2161 decreases with the operation of the movable core 15. As a result, the attractive force between the first springs 2161 by the electromagnetic force increases, and the friction between the first springs 2161 additionally includes a friction based on the attractive force to the conventional dynamic friction, thereby increasing the frictional force. For that reason, it is preferable to prevent the first springs 2161 from coming out of contact with each other.

On the other hand, in the present embodiment, since the return spring 16 is not configured by only the first spring 2161 but the second spring 2162 is placed between the respective windings of the first spring 2161, the contact between the first springs 2161 can be inhibited. Therefore, an increase in the attractive force between the first springs 2161 due to the electromagnetic force can be inhibited, and an increase in the frictional force between the first springs 2161 can be inhibited. A variation in the attractive force characteristics for each product can also be inhibited.

The return spring 16 is configured by multiple springs such as the first spring 2161 and the second spring 2162. For that reason, the first spring 2161 can mainly serve to form the magnetic circuit, and the second spring 2162 can mainly serve to adjust the spring force of the separation spring for urging the movable core 15, the shaft 17, and the like in the non-attraction direction.

For example, in the electromagnetic relay, from the viewpoint of arc interruption in an emergency, a performance for obtaining a desired separation speed is required, and there is a need to design the return spring 16 so as to obtain a spring force of a certain value or more. Although it is complicated to design that such a spring force can be obtained by only the first spring 2161 which mainly functions to form the magnetic circuit, if the second spring 2162 is provided, the design is improved by obtaining the spring force by the second spring 2162.

Therefore, there is no need to cause one spring to perform both those functions as in the case where the return spring 16 is configured by one spring. For that reason, an electromagnetic relay can be provided with the return spring 16 configured to require no complicated design.

Figure 20A:
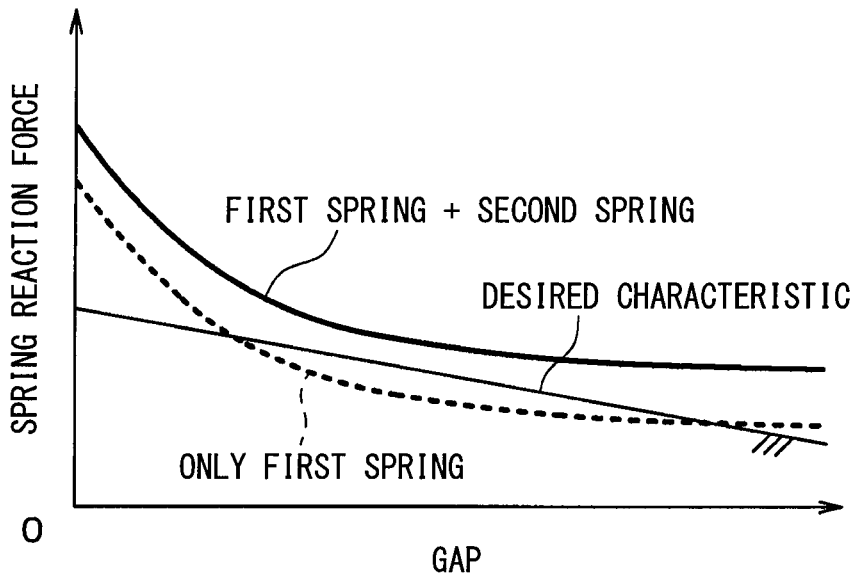
FIG. 20A is a diagram showing a relationship between a gap and a spring reaction force when the spring reaction force is small in only a first spring.
Figure 20B:
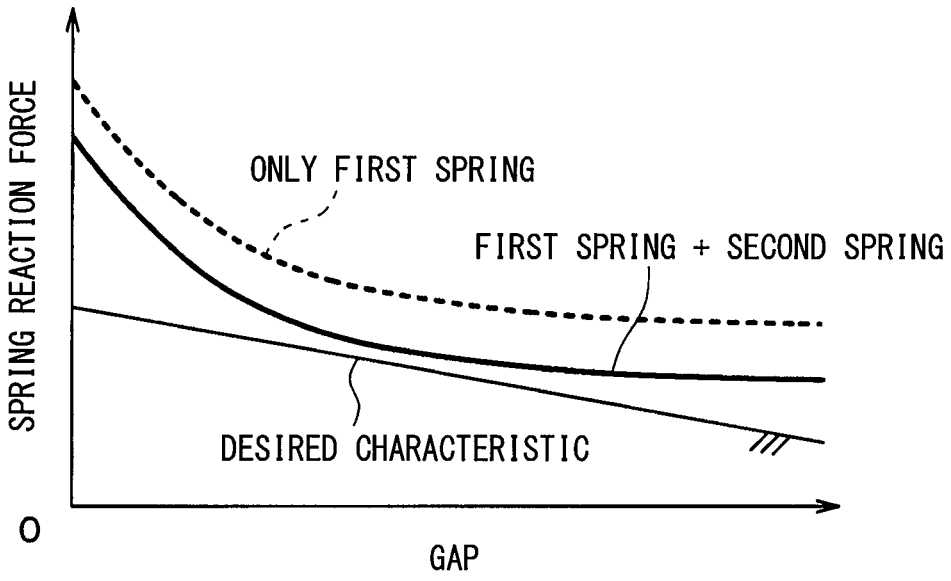
FIG. 20B is a diagram showing a relationship between the gap and the spring reaction force when the spring reaction force of the first spring is too large.

For example, the respective spring characteristics obtained when the return spring 16 is configured with only the first spring 2161 and when the combination of the first spring 2161 and the second spring 2162 is configured are shown in FIGS. 20A and 20B. A gap shown in FIGS. 20A and 20B means a distance between the first fixed contact 25*a* and the second fixed contact 25*b* and the movable contact element 23 with the provision of only the first spring 2161.

The return spring 16 may have any configuration as long as a total spring force of the first spring 2161 and the second spring 2162 can have a desired characteristic as a spring force in a non-attraction direction. For example, when both the first spring 2161 and the second spring 2162 generate the spring force in the non-attraction direction, a spring force larger than that of the first spring 2161 alone is generated. In other words, as shown in FIG. 20A, when the first spring 2161 is designed so as to obtain a desired magnetic attraction force, a relationship between the gap and the spring reaction force may not become a desired characteristic. On the other hand, in the case of the configuration of the present embodiment, the total spring force of the first spring 2161 and the second spring 2162 is a spring reaction force, so that a relationship between the gap and the spring reaction force can have desired characteristics. The lack of the spring reaction force leads to a decrease in the separation speed at the time of contact off, and there is a risk of adverse effects such that the progress of contact wear is advanced. For that reason, since the desired characteristics are obtained, the separation speed can be improved, and the progress of the contact wear can be delayed.

On the other hand, only one of the first spring 2161 and the second spring 2162 may generate a spring force in the non-attraction direction, and the other spring may generate a spring force on a side (hereinafter, referred to as an attraction direction) on which a space between the movable core 15 and the stationary core 13 is contracted. For example, as shown in FIG. 20B, when the first spring 2161 is designed to obtain a desired magnetic attraction force, the total spring reaction force can be reduced by the spring force in the attraction direction of the second spring 2162 when the spring reaction force for the gap is too large. This makes it possible to obtain a desired characteristic as the characteristic of the return spring 16.

When either the first spring 2161 or the second spring 2162 generates a spring force in the attraction direction, both tips of the spring may be connected to a non-movable portion such as the movable core 15, the stationary core 13, the exciting coil 12, or the base 18 on the side generating the spring force in the attraction direction.

Tenth Embodiment

A tenth embodiment will be described. Since the present embodiment is the same as the ninth embodiment except that the configuration of the return spring 16 is changed as compared with the ninth embodiment, only portions different from the ninth embodiment will be described.

Figure 21:
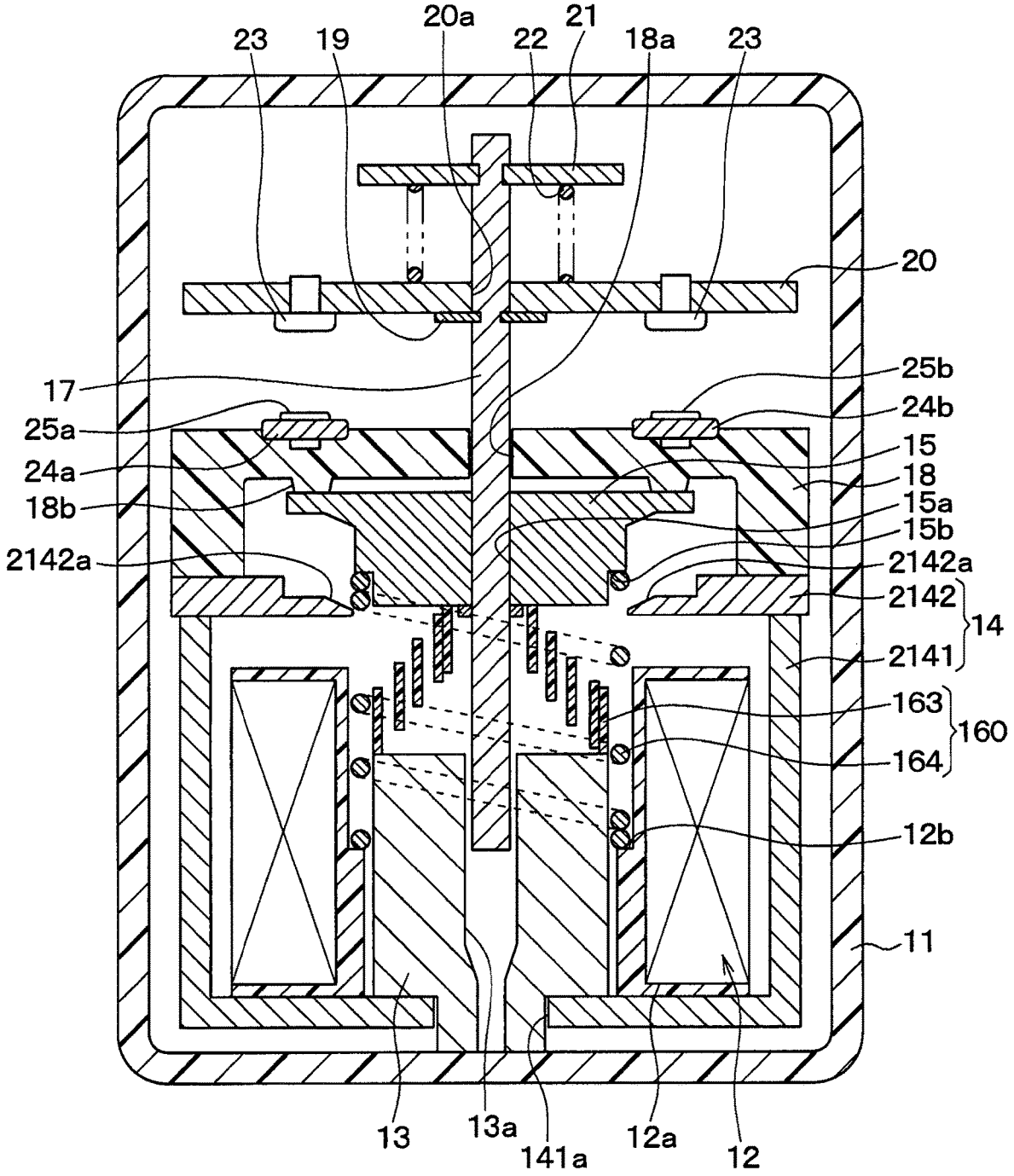
FIG. 21 is a cross-sectional view of an electromagnetic relay according to a tenth embodiment.

As shown in FIG. 21, in the present embodiment, the return spring 16 has a first spring 163 and a second spring 164. The first spring 163 is configured similarly to the first spring 2161 described in the ninth embodiment, but the second spring 164 is configured by a coil spring made of a non-magnetic material.

The second spring 164 is placed outside the first spring 163 so as to surround the first spring 163. A stopper portion 12*b* is formed on the inner peripheral surface of the bobbin 12*a* so that one end of the second spring 164 abuts against the stopper portion 12*b*, and a stopper portion 15*b* is formed on one surface of the movable core 15 on the stationary core 13 side so that the other end of the second spring 164 abuts against the stopper portion 12*b*. The second spring 164 is placed between the stopper portion 12*b* and the stopper portion 15*b*.

As described above, the return spring 16 may be configured by the first spring 163 configured by the volute spring and the second spring 164 configured by the coil spring. In that case, although a contact between the first springs 163 cannot be prevented by the second spring 164, the two springs share a role of mainly forming the magnetic circuit and a role of mainly adjusting the spring force of the separation spring for urging the movable core 15, the shaft 17, and the like in the non-attraction direction. Therefore, also in the configuration of the present embodiment, the electromagnetic relay can be provided with the return spring 16 configured to require no complicated design.

In particular, since the second spring 164 is formed of a coil spring whose spring reaction force can be easily designed, the design can be further facilitated.

Further, since the side force can be reduced by applying a volute spring as the first spring 163 of the return springs 16, the inclination of the movable core 15 and the return spring 16 can be reduced. Further, since the second spring 164 is placed on the outer periphery of the first spring 163, the inclination of the movable core 15 and the return spring 16 can be reduced.

Eleven Embodiment

An eleventh embodiment will be described. The present embodiment is also a configuration in which the configuration of the return spring 16 is changed from that of the ninth embodiment, and the other configuration is the same as that of the ninth embodiment, and therefore only portions different from those of the ninth embodiment will be described.

Figure 22:
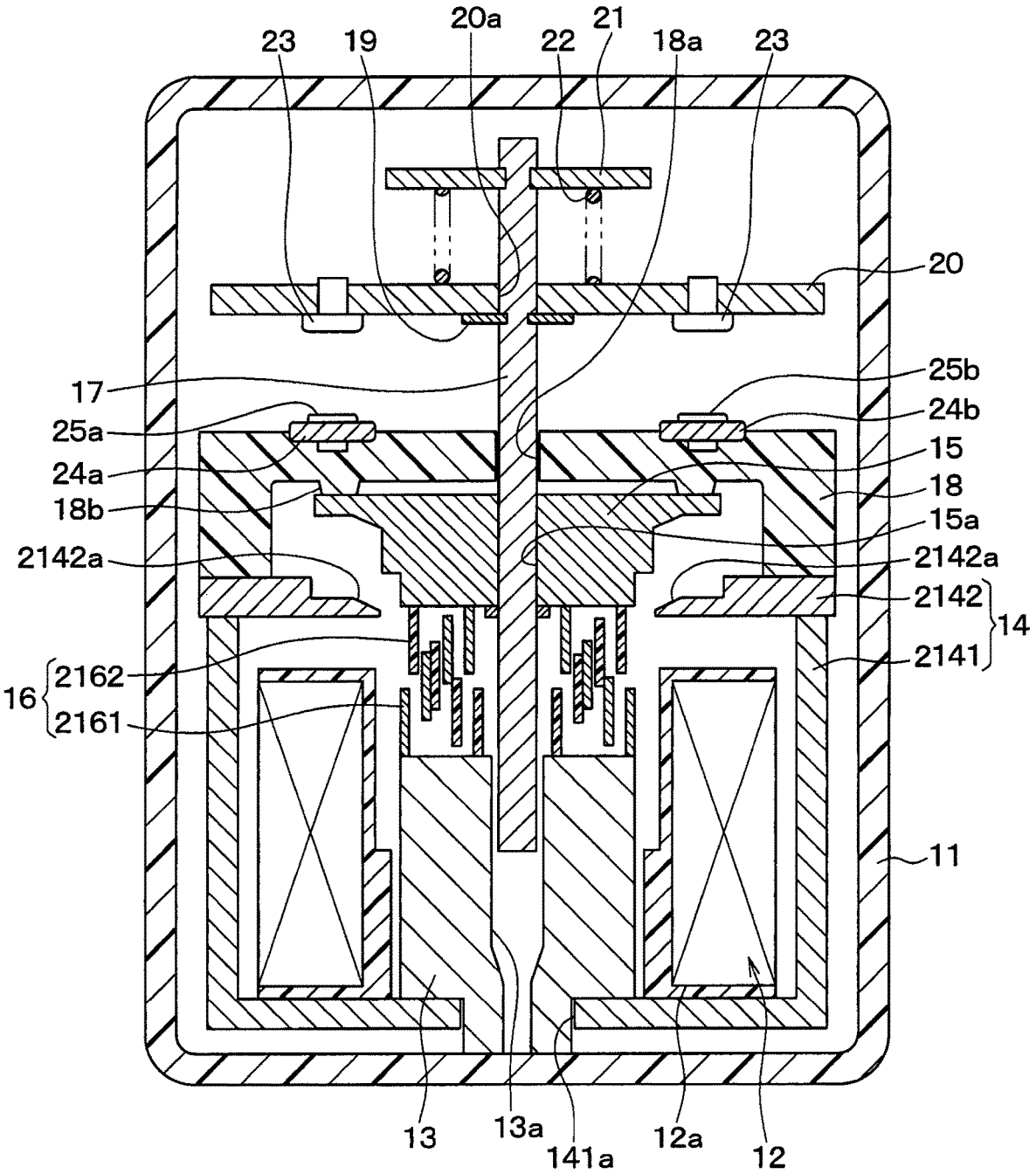
FIG. 22 is a cross-sectional view of an electromagnetic relay according to an eleventh embodiment.

As shown in FIG. 22, in the present embodiment, similarly to the ninth embodiment, the return spring 16 is configured by the first spring 2161 and the second spring 2162 configured by a volute spring, but those springs are not placed in the same direction, and are not formed by an integral structure made of a plywood of a magnetic material and a non-magnetic material so as to be structured separately. A distal end of the first spring 2161 on a smaller diameter side is placed toward the movable core 15 side, and a tip of the first sprint 2161 on a larger diameter side is placed toward the stationary core 13 side. Conversely, a distal end of the second spring 2162 on a smaller diameter side is placed toward the stationary core 13 side, and a tip of the second spring 2162 is placed toward the movable core 15 side.

Even in such a configuration, the second spring 2162 is placed between the windings of the first spring 2161, so that the same effects as those of the ninth embodiment can be obtained.

Twelfth Embodiment

A twelfth embodiment will be described. The present embodiment is also a configuration in which the configuration of the return spring 16 is changed from that of the ninth embodiment, and the other configuration is the same as that of the ninth embodiment, and therefore only portions different from those of the ninth embodiment will be described.

Figure 23:
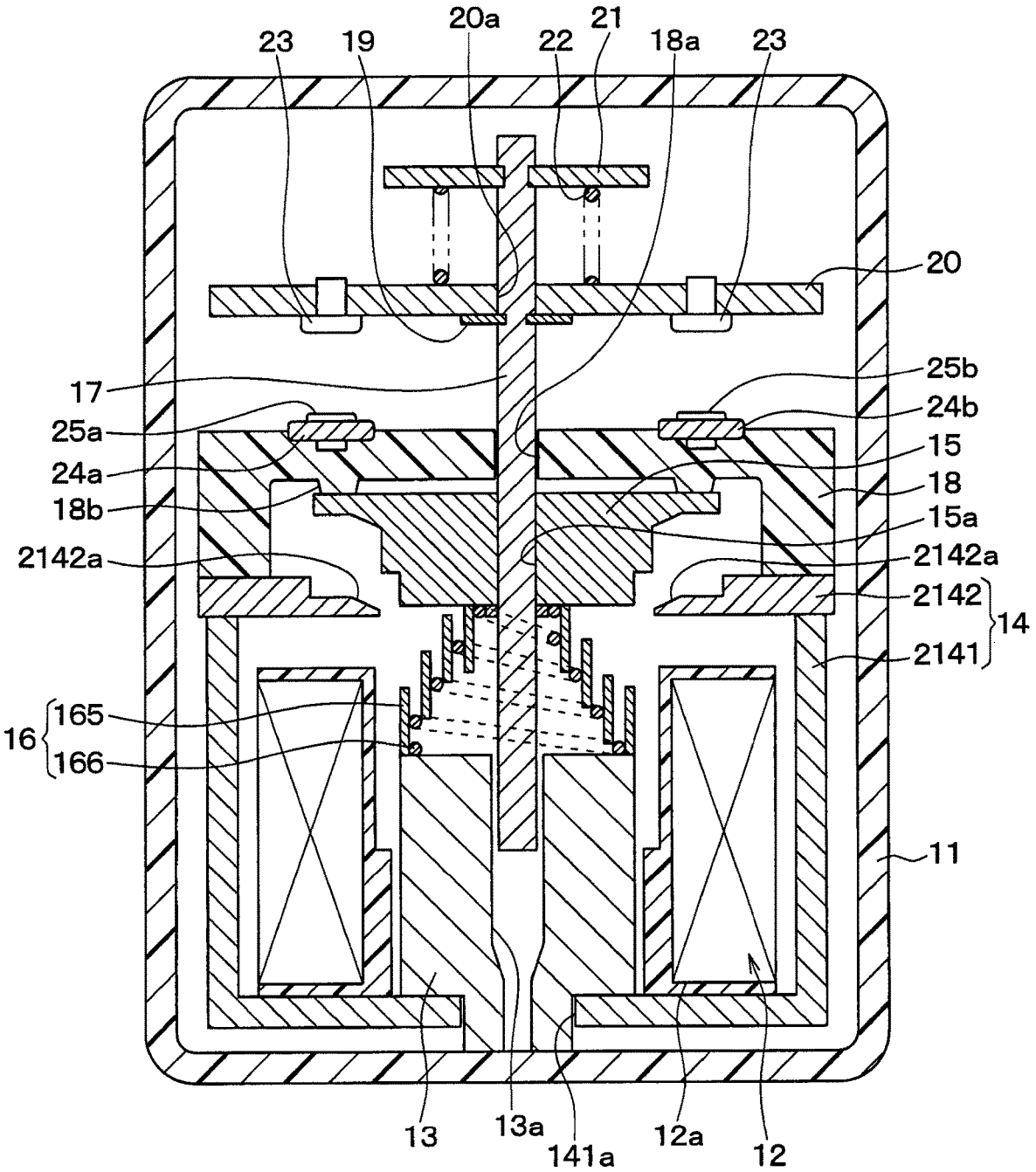
FIG. 23 is a cross-sectional view of an electromagnetic relay according to a twelfth embodiment.

As shown in FIG. 23, in the present embodiment, the return spring 16 has a first spring 165 and a second spring 166. The first spring 165 is configured similarly to the first spring 2161 described in the ninth embodiment, but the second spring 166 is configured by a conical coil spring made of a non-magnetic material. A rate of a change in diameter of the first spring 165 and a rate of a change in diameter of the second spring 166 are set to be the same, so that the second spring 166 is placed between the respective windings of the first spring 165.

In this manner, even if the second spring 166 is configured by a conical coil spring, the same effects as those of the ninth embodiment can be obtained.

Figure 24:
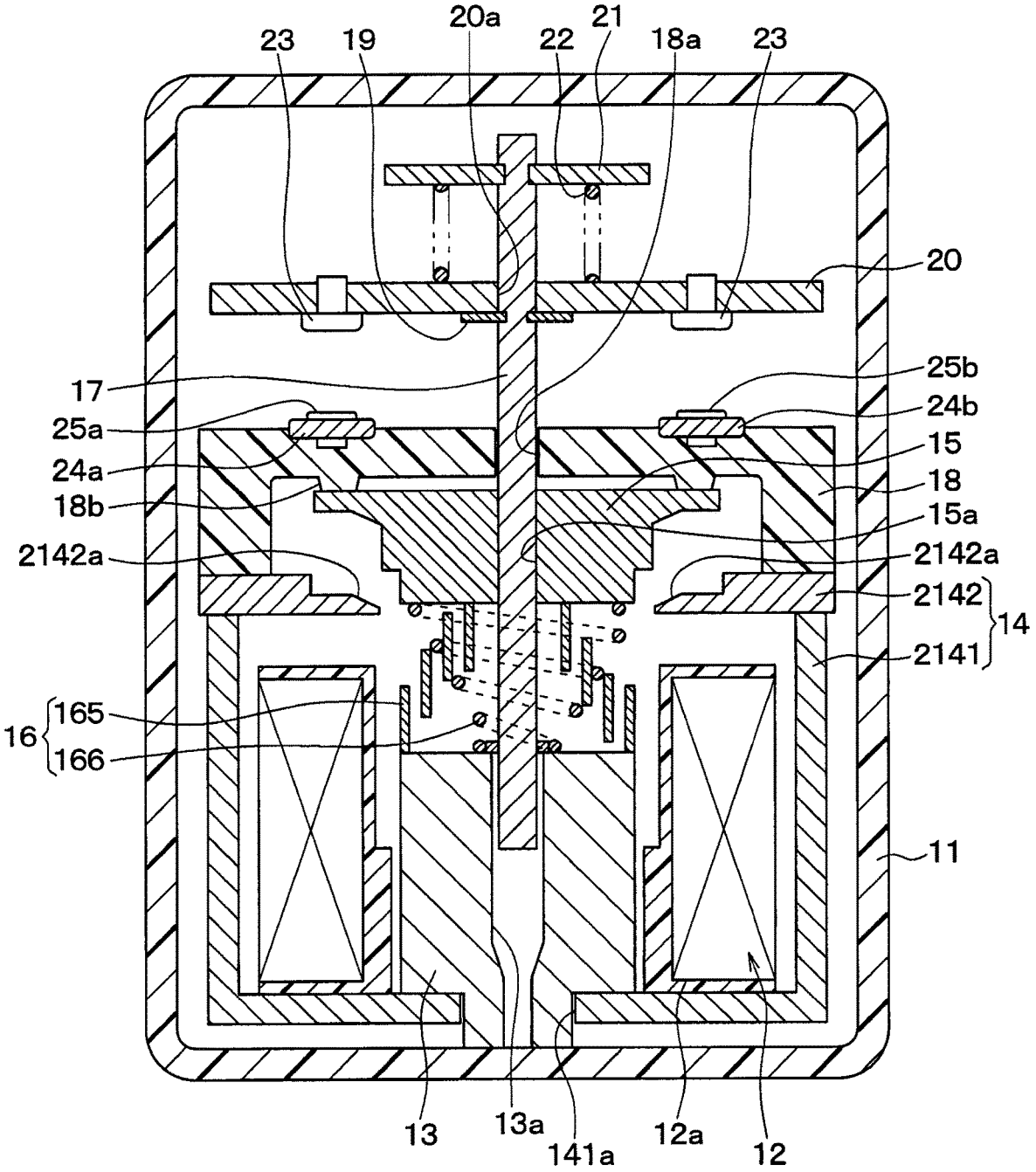
FIG. 24 is a cross-sectional view of an electromagnetic relay according to a modification of the twelfth embodiment.

As described above, even in the case where the second spring 166 is configured by the conical coil spring, as shown in FIG. 24, an orientation of the second spring 166 can be reversed from that in the case of FIG. 23. That is, the tip of the second spring 166 on the smaller diameter side may be directed to the stationary core 13 side, and the tip on the larger diameter side may be directed to the movable core 15 side.

Thirteenth Embodiment

A thirteenth embodiment will be described. In the present embodiment, a placement location of a second spring 164 is changed from that in the tenth embodiment, and the other configuration is the same as that in the tenth embodiment, and therefore, only portions different from those in the tenth embodiment will be described.

Figure 25:
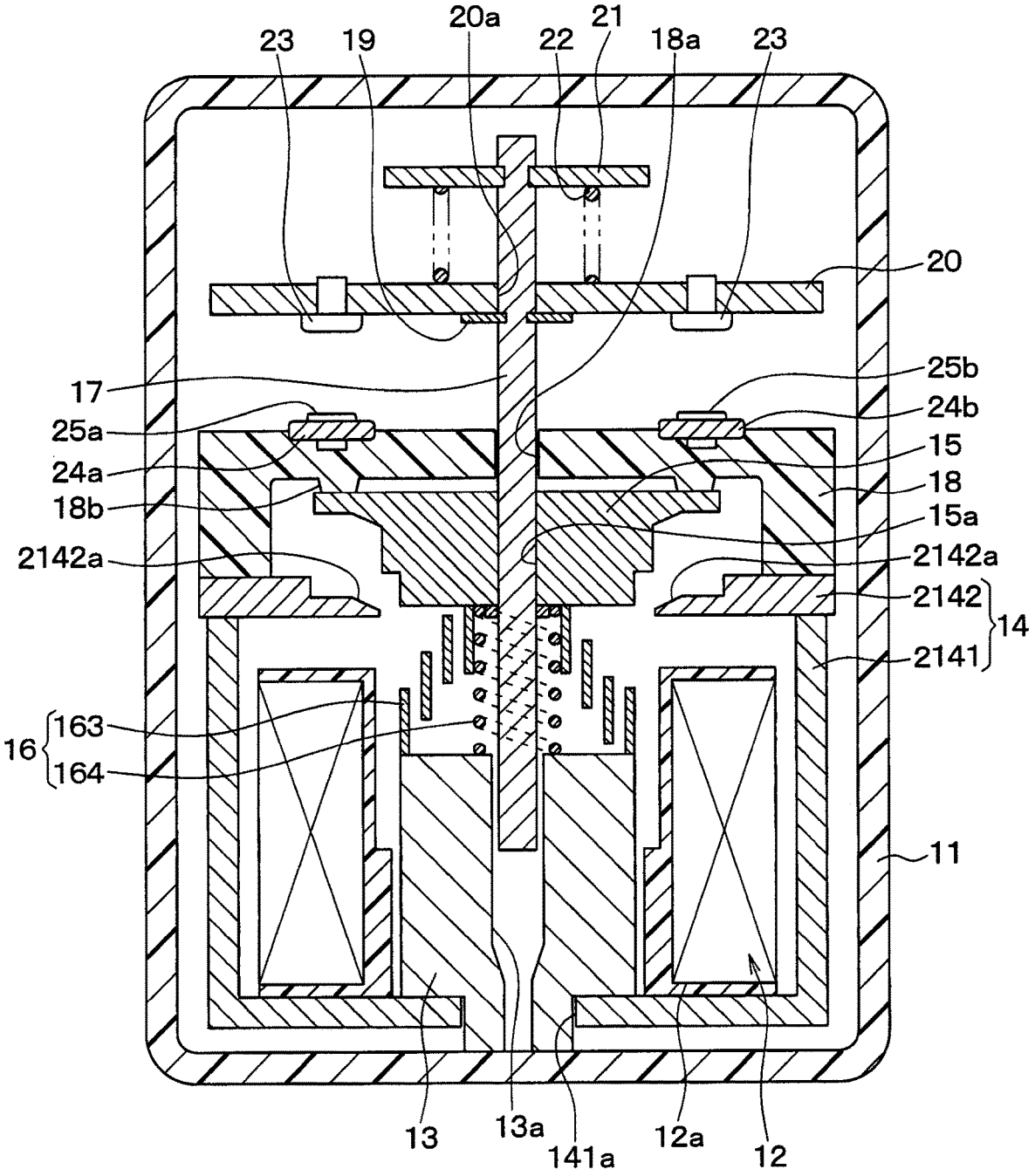
FIG. 25 is a cross-sectional view of an electromagnetic relay according to a thirteenth embodiment.

As shown in FIG. 25, in the present embodiment, similarly to the tenth embodiment, a return spring 16 has a first spring 163 and the second spring 164, and the second spring 164 is placed inside the first spring 163. The second spring 164 is placed between the stationary core 13 and the movable core 15 so as to be in contact the stationary core 13 and the movable core 15.

As described above, the return spring 16 may be configured by the first spring 163 configured by the volute spring and the second spring 164 configured by the coil spring, and the second spring 164 may be placed inside the first spring 163. As a result, the same effects as those of the tenth embodiment can be obtained.

Other Embodiments

The present disclosure is not limited to the embodiments described above, and can be modified as appropriate within the scope described in the claims.

For example, although an example of the configuration of the return spring 16 has been described, other configurations may be used. For example, other elastic members such as leaf springs can be used instead of the volute spring and the coil spring. For example, the return spring 16 can be configured by a first spring configured by a volute spring and a second spring configured by a leaf spring. In that case, for example, the second spring is placed on the outer peripheral side of the first spring so that both tips of the second spring are connected to the stationary core 13 and the movable core 15. Even with such a configuration, the same effects as those of the tenth embodiment and the like can be obtained.

As described above, the electromagnetic relay according to one aspect of the present disclosure includes the exciting coil 110, the stationary core 120, the yoke 130, the movable core 140, and the return spring 150. The exciting coil 110 forms a magnetic field when energized. The stationary core 120 is placed in a coil center hole 113 provided in the inner diameter portion of the exciting coil, and forms a magnetic circuit. The yoke 130 is placed so as to cover the outer peripheral side of the exciting coil and the axial end side of the exciting coil to form a magnetic circuit, and an opening portion 132*a* is provided on one axial side so as to correspond to the position of the stationary core. The movable core 140 is placed so as to face the stationary core through the opening, and is attracted toward the stationary core on energization of the exciting coil. The return spring 150 urges the movable core in a direction opposite to the attraction direction. The first gap 161 is provided between the stationary core and the movable core when the exciting coil is not energized. The second gap 162 may be provided between the yoke and the movable core on deenergization of the exciting coil, and may generate an attractive force in a direction in which the movable core is attracted toward the stationary core between the yoke and the movable core on energization of the exciting coil. The return spring is made of a magnetic material and is provided to magnetically bridge the first gap or the second gap.

According to the above disclosure, the return spring 150 made of a magnetic material is placed so as to magnetically bridge one gap 161 of the first gap 161 and the second gap 162, whereby the generation of the attractive force at the time of energization in one gap 161 is reduced.

However, the magnetoresistance in one gap 161 can be reduced by the return spring 150 made of a magnetic material, and the total magnetic flux passing through the stationary core 120, the movable core 140, and the yoke 130 can be increased when the exciting coil 110 is energized.

As the total magnetic flux increases, an attractive force generated in the other gap 162 which is not magnetically bridged by the return spring 150 can be increased. In general, this increased attractive force can improve the attractive force acting on the movable core 140 toward the stationary core 120.

As described above, the electromagnetic relay according to another embodiment of the present disclosure includes the exciting coil 12, the stationary core 13, the yoke 14, the movable core 15, the movable contact 20, the multiple fixed terminals 24*a* and 24*b*, and the return spring 16. The exciting coil 12 forms a magnetic field on energization. The stationary core 13 is placed in a center hole formed in an inner diameter portion of the exciting coil, and forms a part of a magnetic circuit formed on the basis of energization of the exciting coil. The yoke 14 is placed so as to cover one of the outer peripheral side and the end side in the axial direction of the exciting coil, and forms a part of the magnetic circuit, and an opening portion 2142*a* is provided so as to correspond to the position of the stationary core on one side in the axis line direction. The movable core 15 is placed to face the stationary core at a position corresponding to the opening, and is attracted toward the stationary core by a magnetic attraction force on energization of the exciting coil. The movable contact 20 has a movable contact element 23 and operates to follow the movable core. The multiple fixed terminals 24*a* and 24*b* have fixed contacts 25*a* and 25*b* against which the movable contacts abut on energization of the exciting coil. The return spring 16 urges the movable core away from the stationary core. In such a configuration, the return spring is configured by the multiple springs 2161 and 2162, and at least one of the multiple springs is made of a magnetic material.

As described above, since the return spring is configured by multiple springs and at least one of the multiple springs is made of a magnetic material, and the spring made of the magnetic material can configure a magnetic circuit, and the other springs can function to adjust a spring force of the separation spring for urging the movable core 15, the shaft 17, and the like in the non-attraction direction. Therefore, there is no need to cause one spring to perform both the functions as in the case where the return spring is configured by one spring. This makes it possible to provide an electromagnetic relay that can be used as a return spring configured to require no complicated design.

Other Embodiments

In each of the embodiments described above, a predetermined device using the electromagnetic relays 100A to 100H is, for example, an inverter for power conversion, but the present disclosure is not limited to the inverter, and is widely applicable to an electric device requiring on/off control.

In addition, although an example in which the coil spring 150 and the conical springs 150A and 1508 are used as the return springs has been described, a leaf spring or the like may be used.

Although the present disclosure has been described in accordance with the examples, it is understood that the present disclosure is not limited to such examples or structures. The present disclosure encompasses various modifications and variations within the scope of equivalents. In addition, various combinations and configurations, as well as other combinations and configurations that include only one element, more, or less, are within the scope and spirit of the present disclosure.

The invention claimed is:

1. An electromagnetic relay comprising:

an exciting coil configured to form a magnetic field on energization;

a stationary core placed in a coil center hole formed in an inner diameter portion of the exciting coil and configured to form a magnetic circuit;

a yoke placed to cover an outer periphery of the exciting coil and an end of the exciting coil in an axial direction to form a magnetic circuit, the yoke having an opening portion formed in its one side in the axial direction correspondingly to a position of the stationary core;

a movable core facing the stationary core through the opening portion and configured to be attracted toward the stationary core on energization of the exciting coil; and a return spring configured to urge the movable core in a direction opposite to a direction of attraction, wherein a first gap is formed between the stationary core and the movable core on deenergization of the exciting coil, a second gap is formed between the yoke and the movable core on deenergization of the exciting coil, the second gap allowing the yoke and the movable core to generate an attractive force therebetween in a direction to attract the movable core toward the stationary core on energization of the exciting coil, and the return spring is made of a magnetic material and is placed to magnetically bridge the first gap or the second gap.

2. The electromagnetic relay according to claim 1, wherein the return spring is placed to magnetically bridge the first gap, and the return spring is in part positioned between the stationary core and a periphery of the opening portion at a start of energization.

3. The electromagnetic relay according to claim 1, wherein the return spring is placed to magnetically bridge the first gap, and the return spring is in part placed to pass between the stationary core and a periphery of the opening portion during a period from a start of energization to a completion of attraction.

4. The electromagnetic relay according to claim 3, wherein a spring pitch in a region of the return spring passing between the stationary core and the periphery of the opening portion is set to be smaller than a spring pitch in an other region.

5. The electromagnetic relay according to claim 1, wherein the return spring is in contact with the stationary core and the movable core during a period from a start of energization to a completion of attraction.

6. The electromagnetic relay according to claim 5, wherein the return spring is placed between facing surfaces of the stationary core and the movable core which face each other.

7. The electromagnetic relay according to claim 6, wherein when the movable core is in an attractive state, a distance between the stationary core and the movable core is equal to a minimum length of the return spring.

8. The electromagnetic relay of claim 7, wherein the return spring is a conically wound conical spring.

9. The electromagnetic relay according to claim 1, wherein the return spring is in contact with the movable core and the yoke during a period from a start of energization to a completion of attraction.

10. An electromagnetic relay comprising:

an exciting coil configured to form a magnetic field on energization;

a stationary core placed in a center hole formed in an inner diameter portion of the exciting coil and configured to form a part of a magnetic circuit on energization of the exciting coil;

a yoke placed to cover an outer periphery of the exciting coil and an end of the exciting coil in the axial direction and configured to form a part of the magnetic circuit, the yoke having an opening portion correspondingly to a position of the stationary core in its one side in the axial direction;

a movable core facing the stationary core at a position corresponding to the opening portion and configured to be attracted toward the stationary core by a magnetic attraction force on energization of the exciting coil;

a movable contact having a movable contact element and movable to follow the movable core;

a plurality of fixed terminals having fixed contacts configured to make contact with the movable coil on energization of the exciting coil; and a return spring configured to urge the movable core in a direction away from the stationary core, wherein the return spring is formed of a plurality of springs, and at least one of the plurality of springs is made of a magnetic material.

11. The electromagnetic relay according to claim 10, wherein the spring made of the magnetic material among the plurality of springs is a volute spring.

12. The electromagnetic relay according to claim 10, wherein at least one of the plurality of springs is made of a non-magnetic material.

13. The electromagnetic relay according to claim 12, wherein the spring made of the non-magnetic material among the plurality of springs is placed between respective windings of the spring made of the magnetic material.

14. The electromagnetic relay according to claim 10, wherein at least one of the plurality of springs is made of a non-magnetic material, and the spring made of the magnetic material and the spring made of a non-magnetic material among the plurality of springs are volute springs formed of plywood in which the magnetic material and the non-magnetic material are combined together.

15. The electromagnetic relay according to claim 10, wherein at least one of the plurality of springs is configured to generate a spring force urging in an attraction direction to attract the movable core to the stationary core.

16. The electromagnetic relay according to claim 15, wherein one end of the spring, which is configured to generate the spring force urging in the attraction direction, is fixed to the movable coil, and the other end is fixed to a non-movable portion including the stationary core, the exciting coil, and the yoke.

* * * * *